US007267505B2

(12) United States Patent
Kennedy et al.

(10) Patent No.: US 7,267,505 B2
(45) Date of Patent: Sep. 11, 2007

(54) MINE VENTILATION PANEL SYSTEM

(75) Inventors: William R. Kennedy, Taylorville, IL (US); John M. Kennedy, Taylorville, IL (US)

(73) Assignee: Kennedy Metal Products & Buildings, Inc., Taylorville, IL (US)

( * ) Notice: Subject to any disclaimer, the term of this patent is extended or adjusted under 35 U.S.C. 154(b) by 208 days.

(21) Appl. No.: 10/951,116

(22) Filed: Sep. 27, 2004

(65) Prior Publication Data

US 2005/0101243 A1 May 12, 2005

Related U.S. Application Data

(60) Provisional application No. 60/545,520, filed on Feb. 18, 2004, provisional application No. 60/518,853, filed on Nov. 10, 2003.

(51) Int. Cl.
*E21F 1/14* (2006.01)

(52) U.S. Cl. ..... 405/132; 405/288; 454/169

(58) Field of Classification Search ..... 405/288, 405/132, 137, 135, 150.1, 151–153; 454/169
See application file for complete search history.

(56) References Cited

U.S. PATENT DOCUMENTS

| | | | | |
|---|---|---|---|---|
| 2,729,064 | A | 1/1956 | Kennedy et al. | |
| 3,097,494 | A * | 7/1963 | Chapron | 405/153 |
| 3,417,568 | A * | 12/1968 | Henderson | 405/133 |
| 3,762,687 | A | 10/1973 | De Rome et al. | |
| 4,398,847 | A | 8/1983 | Horowitz et al. | |
| 4,439,065 | A * | 3/1984 | Constapel | 405/151 |
| 4,483,642 | A | 11/1984 | Kennedy et al. | |
| 4,484,837 | A | 11/1984 | Kennedy et al. | |
| 4,547,094 | A | 10/1985 | Kennedy et al. | |
| 4,695,035 | A | 9/1987 | Kennedy et al. | |
| RE32,675 | E | 5/1988 | Kennedy et al. | |
| RE32,871 | E | 2/1989 | Kennedy et al. | |
| 4,820,081 | A | 4/1989 | Kennedy et al. | |
| 5,167,474 | A | 12/1992 | Kennedy et al. | |
| 5,224,687 | A | 7/1993 | Geckler, deceased et al. | |
| 5,412,916 | A | 5/1995 | Kennedy et al. | |
| 5,466,187 | A | 11/1995 | Kennedy et al. | |
| 5,564,866 | A * | 10/1996 | Snyder | 405/288 |
| 6,129,483 | A * | 10/2000 | Juracko | 405/288 |
| 6,220,785 | B1 | 4/2001 | Kennedy et al. | |
| 6,264,549 | B1 | 7/2001 | Kennedy et al. | |
| 6,334,738 | B1 * | 1/2002 | Juracko | 405/132 |
| 6,379,084 | B1 | 4/2002 | Kennedy et al. | |
| 6,457,906 | B1 | 10/2002 | Kennedy et al. | |
| 6,669,551 | B2 * | 12/2003 | Kennedy et al. | 454/169 |
| 6,682,263 | B2 | 1/2004 | Kennedy et al. | |
| 6,688,813 | B2 | 2/2004 | Kennedy et al. | |
| 6,715,961 | B2 | 4/2004 | Kennedy et al. | |
| 6,846,132 | B2 * | 1/2005 | Kennedy et al. | 405/132 |

FOREIGN PATENT DOCUMENTS

GB 2171432 A * 8/1986

* cited by examiner

*Primary Examiner*—Frederick L. Lagman
(74) *Attorney, Agent, or Firm*—Senniger Powers

(57) ABSTRACT

A panel system for making mine ventilation structures. The panel system comprises a plurality of elongate metal panels having flanges along sides thereof configured for overlapping one another when the panels are placed in side-by-side relation. When the panels are secured together they form a unitary load-bearing structure. Related methods and equipment for installing the panels are also disclosed.

75 Claims, 31 Drawing Sheets

3
7
19
21
25
27
33
41
43
47
51
53
55
57
61
65
69
75
77
79
81
83
89
A
9
10

MINE VENTILATION PANEL SYSTEM

CROSS-REFERENCE TO RELATED APPLICATION

This application claims priority from U.S. Patent Application No. 60/518,853 (provisional), filed Nov. 10, 2003, and U.S. Patent Application No. 60/545,520 (provisional) filed Feb. 18, 2004.

BACKGROUND OF THE INVENTION

This invention relates to mine ventilation and, more particularly, to a new panel system for making mine ventilation structures.

In particular, the present invention represents an improvement on mine ventilation panel systems of the type described in U.S. Pat. Nos. 2,729,064, 4,483,642, 4,547,094 (reissued as Re. 32,871), U.S. Pat. Nos. 4,695,035, 4,820,081, 5,167,474, 5,412,916, 5,466,187, 6,220,785 and 6,264,549, all of which are incorporated herein by reference in their entireties. These prior systems have been used to make various mine ventilation structures, such as stoppings, overcasts and undercasts. The use of these systems have been widespread and successful in improving mine ventilation. For a discussion of the principles of mine ventilation, the practical application of such principles to mining ventilation problems, and the structures used to achieve proper ventilation in a mine, reference may be made to the book entitled "Practical Mine Ventilation" by William R. Kennedy, co-inventor of the improved panel system described herein for making such structures. This book is incorporated herein by reference for all purposes.

SUMMARY OF THE INVENTION

Among the several objects of this invention may be noted the provision of an improved panel system for making mine ventilation structures, such as stoppings, overcasts and undercasts, and the various components of such a panel system, including elongate metal panels, clamping devices for securing the panels together, and a unique jack for installing the panels, and related methods; the provision of such a panel system in which such components are used to make mine stoppings and other mine ventilation structures which are stronger, lighter and require less materials for reduced cost; the provision of such a panel system which can be used to make ventilation structures which are less prone to leakage; the provision of such a panel system which enables faster installation of the ventilation structure being formed; the provision of such a panel system which can be used to construct stoppings which are contractible in the vertical direction after installation to accommodate convergence between the roof and floor of the mine without damage to the stopping; and the provision of such a panel system having improved resistance to contraction in the vertical direction.

In one aspect, the present invention is directed to a panel system for making mine ventilation structures. The panel system comprises a plurality of elongate metal panels having flanges along sides thereof configured for overlapping one another when the panels are placed in side-by-side relation whereby when the panels are secured together they form a unitary load-bearing structure.

In another aspect, the present invention is directed to a panel securing system for securing first and second elongate panels together in side-by-side relation in a mine passageway with a side flange along one side of the first panel overlapping a side flange along an adjacent side of the second panel. The panel securing system comprises at least one clamping device for clamping the overlapping flanges of adjacent panels against one another to hold the panels together in side-by-side relation. The clamping device is adapted to be positioned on the overlapping flanges of adjacent panels and moved to a clamping position in which the clamping device applies a clamping force to the overlapping flanges.

In another aspect, the present invention is directed to at least one clamping device adapted to be positioned on the overlapping flanges of adjacent panels and moved to a clamping position in which the clamping device applies a clamping force to the overlapping flanges sufficient to hold the adjacent panels together in said side-by-side relation. The at least one clamping device comprises a clamp and a lever for pivoting the clamp to its clamping position to bring a portion of the clamp into pressure engagement with the overlapping flanges to clamp the flanges together.

In another aspect, the present invention is directed to a jack for installing in a mine a plurality of elongate extensible panels adapted to extend in side-by-side relation. Each panel comprises a lower panel member of the panel and an upper member of the panel, each of the lower and upper panel members of a panel being a sheet metal member having a web and first and second flanges along opposite sides of the web. One of the panel members has a telescoping sliding fit relative to the other panel member with the webs of the panel members generally face-to-face. The upper panel member of each panel has an end piece at its upper end and the lower panel member of each panel has an end piece at its lower end. The jack comprises a base adapted to engage a first end piece of one of the upper and lower panel members, a guide extending from the base, and an extensible member having an extensible fit with the guide and extending from the guide to have a free end. A support at the free end of the extensible member is adapted to engage a second end piece of the upper and lower panel members. An actuator on the jack is used for extending the extensible member to move the support into pressure engagement with the second end piece. The guide and extensible member have portions which are laterally offset with respect to the base and the support such that when the support is in pressure engagement with the second end piece, the laterally offset portions are disposed adjacent one side of the panel to leave an area between opposite sides of the panel substantially unobstructed.

In another aspect, a jack of the present invention has a mechanical actuator comprising a first gripping mechanism movable up and down relative to the extensible member, a second gripping mechanism on the guide and a lever device mounted on the guide for movement through an extension stroke to raise the first gripping mechanism and through a retraction stroke to lower the first gripping mechanism. The first gripping mechanism is operable to grip the extensible member during an extension stroke of the lever device thereby to extend the extensible member relative to the guide and to release the extensible member during a retraction stroke. The second gripping mechanism is operable to hold the extensible member against retraction relative to the guide as the lever device is moved through a retraction stoke prior to the next extension stroke. A release mechanism is provided for releasing the gripping system to permit retraction of the extensible member relative to the guide without moving the lever device through a series of strokes.

In another aspect, a jack of the present invention has a handle on the guide engageable with a panel when the support and base of the jack are positioned adjacent respective end pieces of the panel to facilitate transport and handling of the jack and the panel as a unit.

The present invention is also directed to a method of making a mine ventilation structure from a plurality of elongate metal panels having flanges along opposite sides thereof. The method comprises the steps of placing the panels in side-by-side relation with the flanges of one panel overlapping the flanges of an adjacent panel, and securing the panels together in side-by-side relation to form a unitary load-bearing structure.

In another aspect, a method of the present invention involves using an extensible jack to carry elongate panels used to make a mine ventilation structure. The method comprises the steps of securing the jack to one of the panels at a first location, grasping a handle on the jack, manually lifting the jack and the panel secured thereto using the handle, and carrying the jack and panel to a second location for installation of the panel at the second location. The steps described above are then repeated for a second panel.

In another aspect, a method of the present invention involves using a jack to extend an extensible panel to make a mine ventilation structure. The jack is of the type comprising an extensible member and a mechanical actuator comprising a lever device for extending the extensible member. The method comprises the steps of bringing opposite ends of the jack into engagement with opposite ends of the panel, moving the lever device through a first range of movement to extend the jack and the panel at a first relatively high speed and low force, and moving the lever device through a second range of movement different from the first range to extend the jack and the panel at a second relatively low speed and high force.

Other objects and features will be in part apparent and in part pointed out hereinafter.

BRIEF DESCRIPTION OF THE DRAWINGS

Corresponding parts are designated by corresponding reference numbers throughout the several views of the drawings.

DETAILED DESCRIPTION OF PREFERRED EMBODIMENTS

Figure 1:
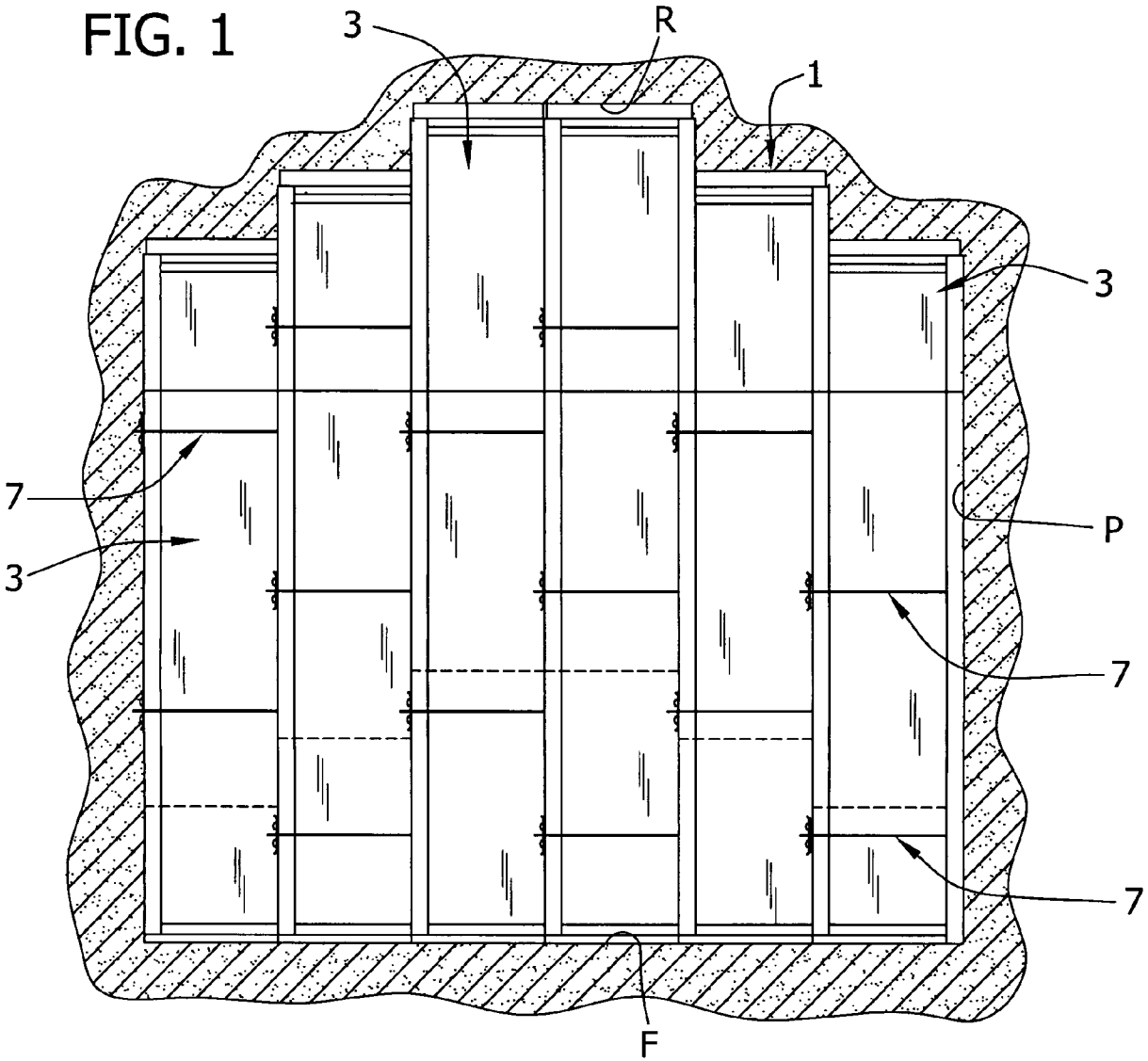
FIG. 1 is a front elevation of a mine stopping installed using a panel system of the present invention.

FIG. 1 shows a mine stopping, generally designated by the reference number 1, installed in a passageway P of a mine. The stopping comprises a plurality of elongate extensible panels 3 adapted to extend vertically in side-by-side relation from the floor F to the roof R of the passageway. A panel securing system comprising a plurality of clamping devices, each generally designated 7, is provided to secure the panels relative to one another, as shown. It will be understood that the panels 3 and clamping devices 7 could be used to make mine ventilation structures other than stoppings, such as overcasts, undercasts and mine seals of the type described in the aforementioned patents, for example.

Figure 2:
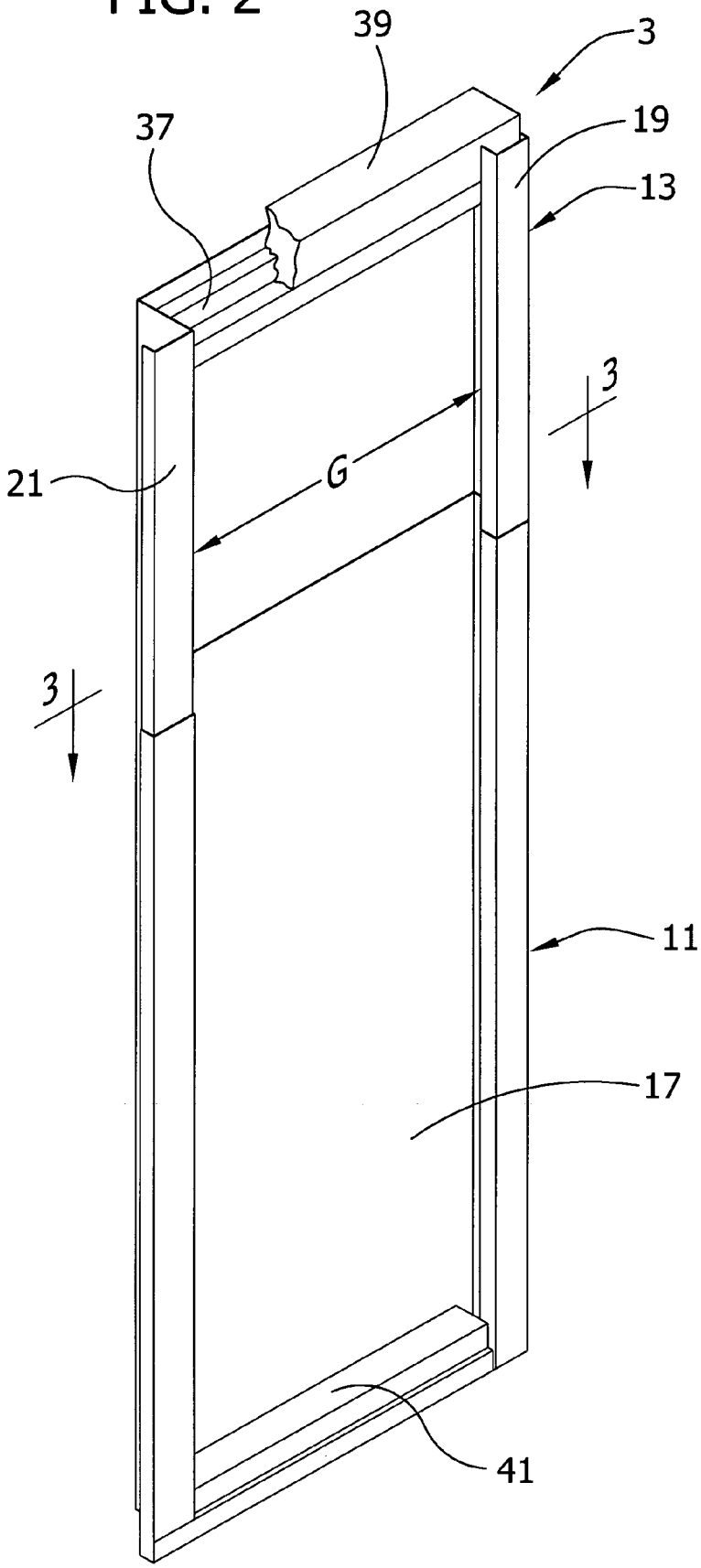
FIG. 2 is a perspective of an extensible panel of the system.
Figure 3:
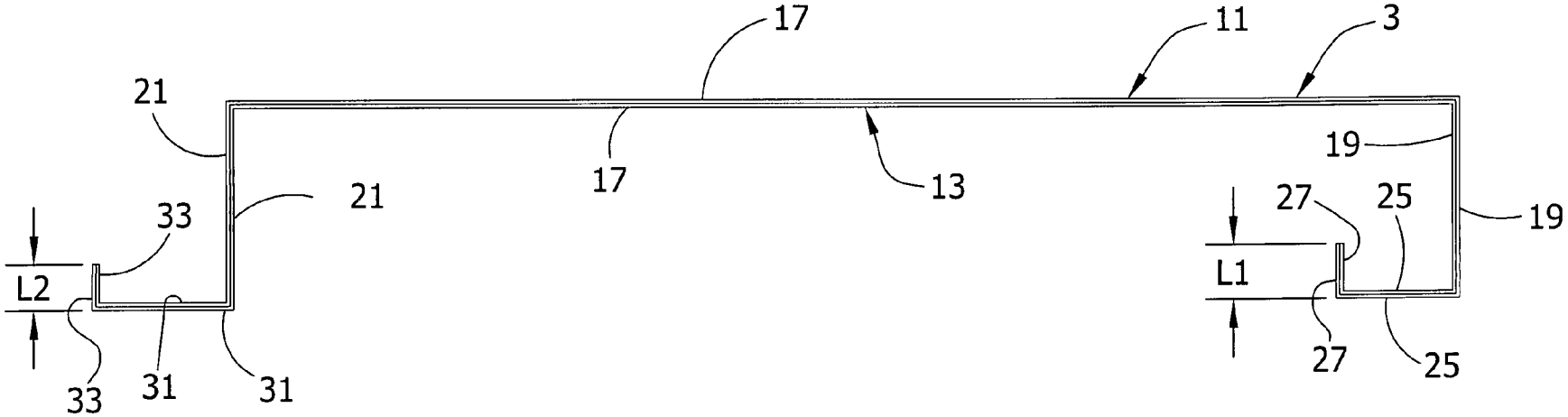
FIG. 3 is an enlarged cross section on 3-3 of FIG. 2.

Referring to FIGS. 2 and 3, each of the panels 3 of the mine stopping is preferably (but not necessarily) constructed of two panel members, namely, a first elongate member constituting a lower panel member 11 of the panel adapted for engagement of its lower end with the floor of the passageway, as shown in FIG. 1, and a second elongate member constituting an upper panel member 13 of the panel adapted for engagement of its upper end with the roof of the passageway. Each panel member 11, 13 is a sheet metal member which, in one embodiment, is generally of channel shape in cross section, having a web 17 and first and second flanges 19, 21 at opposite sides of the web. As shown in FIG. 3, the first flange 19 has an in-turned portion 25 at its outer edge extending generally toward the second flange 21 and generally parallel to the web 17, and a lip 27 at the inner edge of the in-turned portion extending toward the web. The first flange 19 terminates short of the second flange 21 to form a gap therebetween, indicated at G in FIG. 2. The second flange 21 has an out-turned portion 31 (FIG. 3) at its outer edge extending generally away from the first flange 19 and generally in the same plane as the in-turned portion 25 of the first flange, and a lip 33 at the outer edge of the out-turned portion 31 extending generally in the same direction and generally parallel to the lip 27 of the first flange 19. In one embodiment, the lip 27 of first flange 19 extends closer to the web 17 than the lip 33 of the second flange 21, i.e., the first flange 19 has a transverse dimension or width L1 greater than the transverse dimension or width L2 of the second flange 21 (FIG. 3). The upper panel member 13 has a telescoping fit in the respective lower panel member 11, the webs 17 of the members being in sliding engagement. (This could be reversed—the lower panel member having sliding fit in the upper panel member.) The panel members 11, 13 could have other cross sectional shapes, such as a generally Z-cross sectional shape. The panel could also be fabricated as a single panel member or more than two panel members.

As shown in FIG. 2, the upper panel member 13 desirably has an upper end piece in the form of a head 37 at its upper end and a sealing member 39 in the head adapted for sealing engagement with the roof R of the mine passageway P, and the lower panel member 11 desirably has a lower end piece in the form of a foot 41 at its lower end for engagement with the floor of the passageway. For additional detail regarding the head 37, sealing member 39 and foot 41, reference may be made to co-assigned U.S. Pat. No. 4,483,642, incorporated herein by reference.

Figure 4:
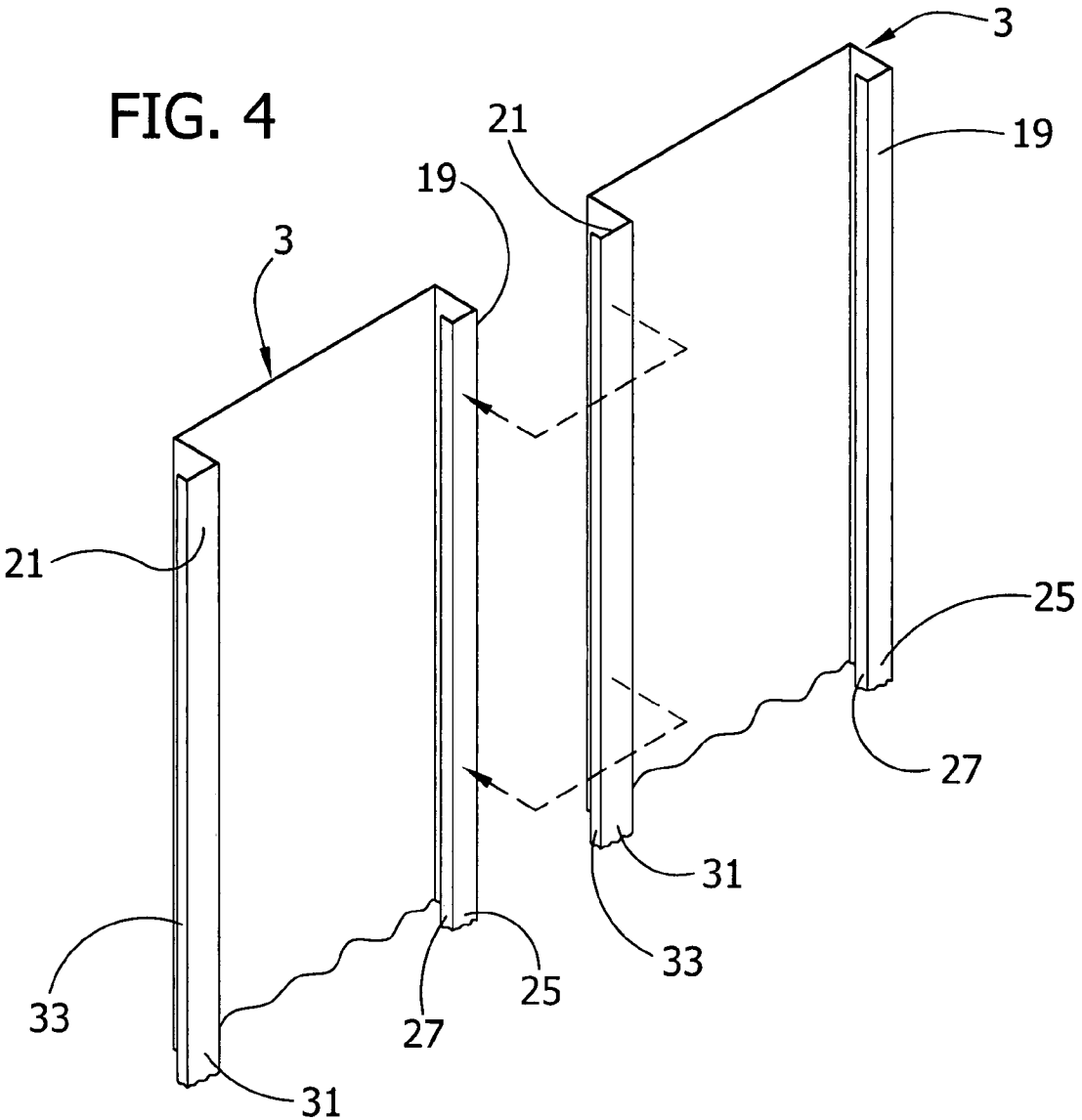
FIG. 4 is an exploded view of two extensible panels in side-by-side position.
Figure 5:
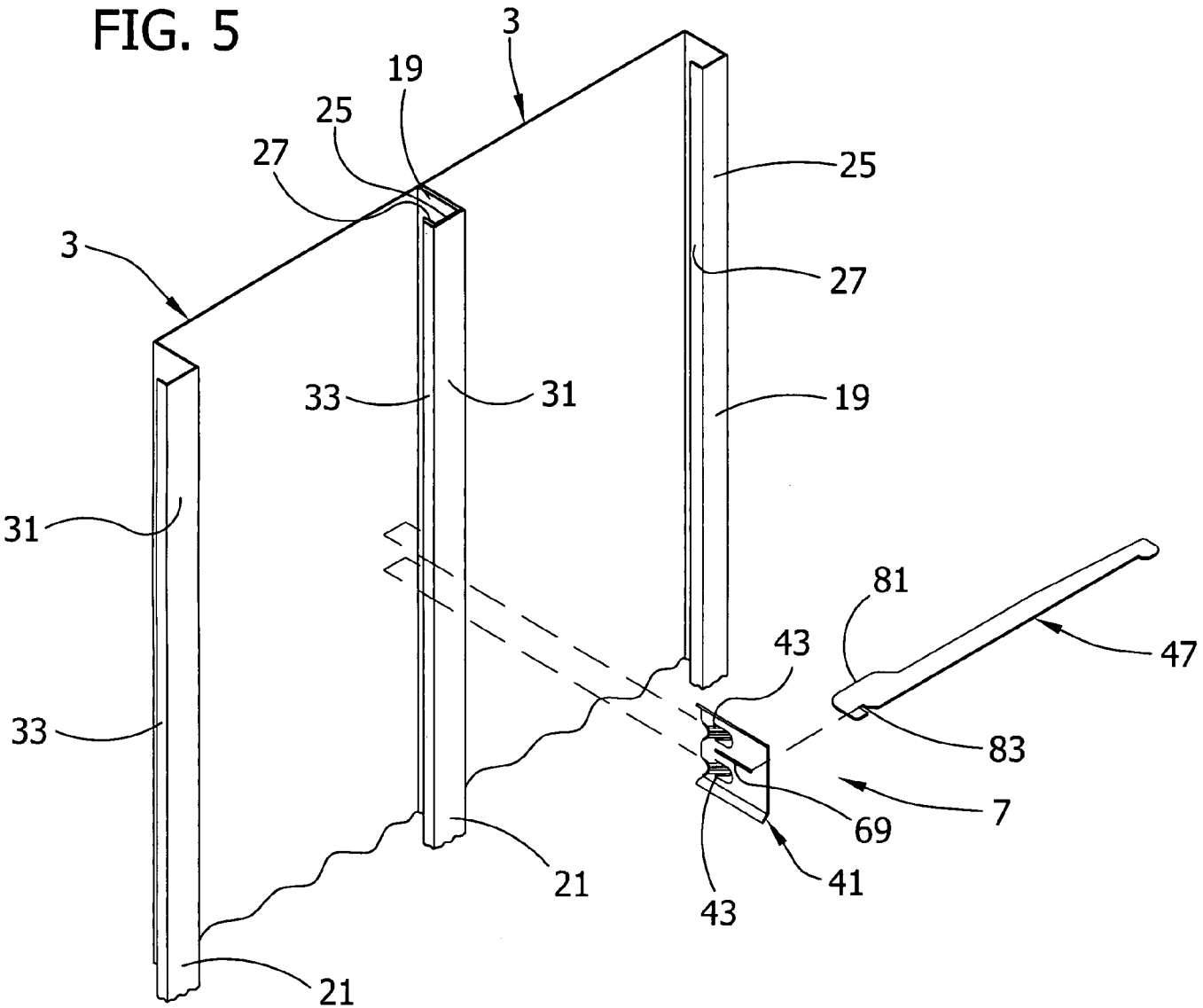
FIG. 5 is a perspective of two panels positioned in adjacent, side-by-side overlapping position, and a clamping device for securing the two panels together in such position.

FIGS. 4 and 5 show two panels 3 positioned in vertical side-by-side relation with the side flanges 21 along one side of the first (right) panel generally adjacent the side flanges 19 along an adjacent side of the second (left) panel. As thus positioned, the second (out-turned) flange portions 31 and lips 33 of the upper and lower panel members 11, 13 of the first panel overlap the first (in-turned) flange portions 25 and lips 27 of the upper and lower panel members of the other panel. Any number of panels may be assembled in this way to form the stopping across the mine passageway.

FIGS. 5-10 illustrate one embodiment of a clamping device 7 used for clamping the overlapping in-turned and out-turned flange portions 25, 31 (including lips 27, 33) of adjacent panels against one another to yieldably hold the upper and lower panel members 11, 13 of each panel 3 in fixed position relative to one another while allowing the upper and lower panel members to telescope relative to one another in the event of a convergence between the roof and floor of said passageway. As shown, the clamping device 7 comprises a clamp 41 having at least one panel engaging member 43 thereon, and a lever 47 for applying the clamp.

Figures 8, 9, 10:
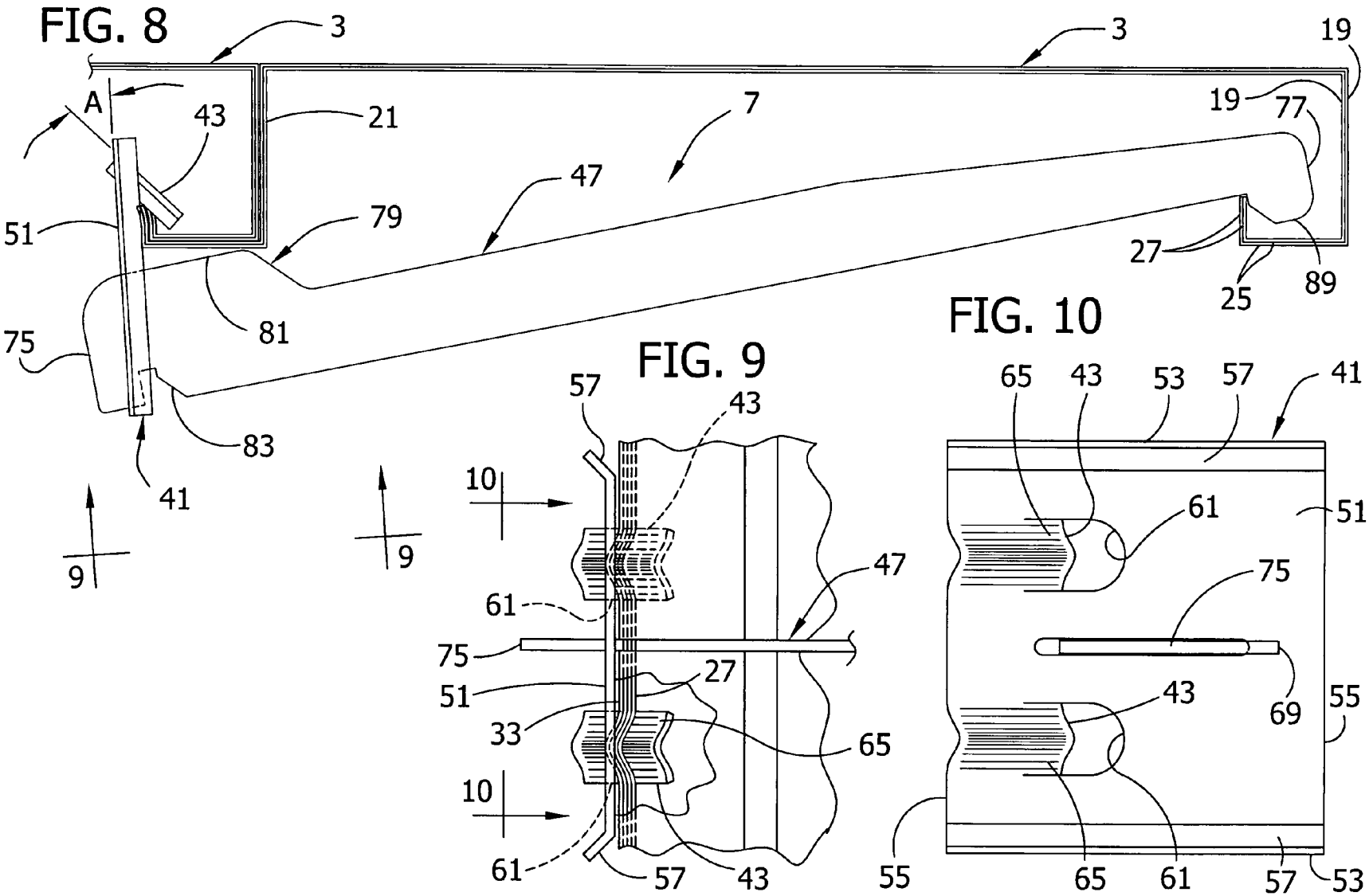
FIG. 8 is an enlarged section on 8-8 of FIG. 7.
FIG. 9 is a view taken in the direction of 9-9 of FIG. 8 showing a clamp of the clamping device in a clamping position in which it deforms the metal of the overlapping panels to secure them in position.
FIG. 10 is a partial view taken in the direction of 10-10 of FIG. 9 showing the clamping device of FIG. 9.

In the illustrated embodiment, the clamp 41 comprises a rigid plate 51 of rectangular shape although other shapes are possible. The plate 51 is preferably of a suitable metal having the thickness and strength characteristics necessary to apply the necessary clamping forces to be described. By way of example, the plate may be fabricated of 14-ga. sheet steel having a thickness of about 0.078 in. The plate 51 has opposite sides 53, opposite ends 55, and is bent to have reinforcing flanges 57 along its opposite sides 53. A pair of panel engaging members 43 extend from one face of the plate 51 (e.g., the face opposite the reinforcing flanges) for placement under the overlapping lips 27, 33 of two adjacent panels 3. As shown in FIGS. 8-10, these panel engaging members resemble tongues which hook under the overlapping lips 27, 33. One desirable fabrication technique is to strike or punch the panel engaging members 43 from the plate 51, leaving a pair of holes 61 (FIG. 10) in the plate. Alternatively, the panel engaging members 43 can be separate members suitably secured (e.g., welded) to the plate. In one embodiment, each panel engaging member extends out from the plate adjacent a respective hole at an angle A (FIG. 8) which is preferably in the range of 30-60 degrees, more preferably in the range of 40-50 degrees, and most preferably about 45 degrees. Each panel engaging member 43 is generally arcuate in cross section (FIGS. 9 and 10), thus providing a curved surface 65 which is adapted for contacting the edges of the overlapping lips 27, 33 when the clamp 41 is applied to the panels 3. By way of example, each of the two tongues 43 may have a flange-engaging outer surface 65 curved on an arc having about a 0.375 in. radius, and the longitudinal axes of the tongues may be spaced apart about 1.875 in. The panel engaging members 43 may have other configurations. The number of such members may also vary. For example, the clamp 41 may have only one or more than two panel engaging members 43. A slot 69 (FIG. 10) is provided in the plate 51 midway between the two holes 61 extending generally parallel to the sides 53 of the plate. This slot is sized for receiving the lever 47 to secure the clamp 41 in place in the manner described below.

Figure 6:
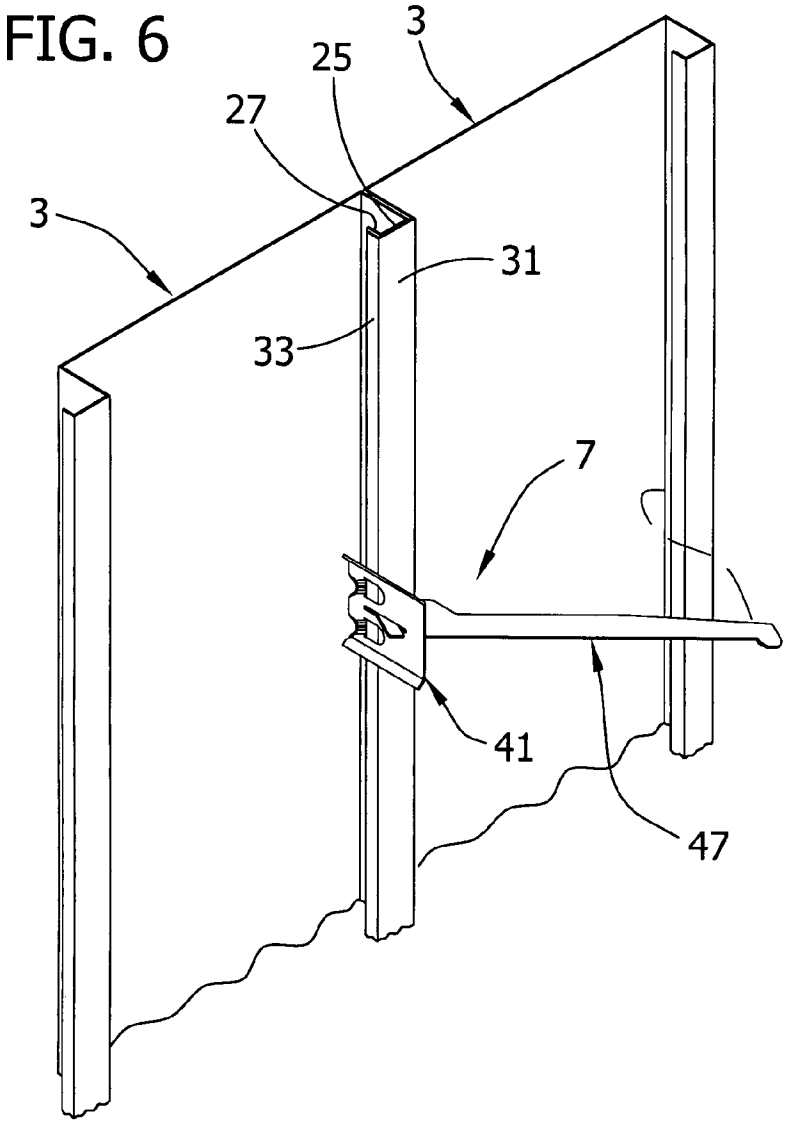
FIGS. 6 and 7 are views similar to FIG. 5 illustrating operation of the clamping device.
Figure 7:
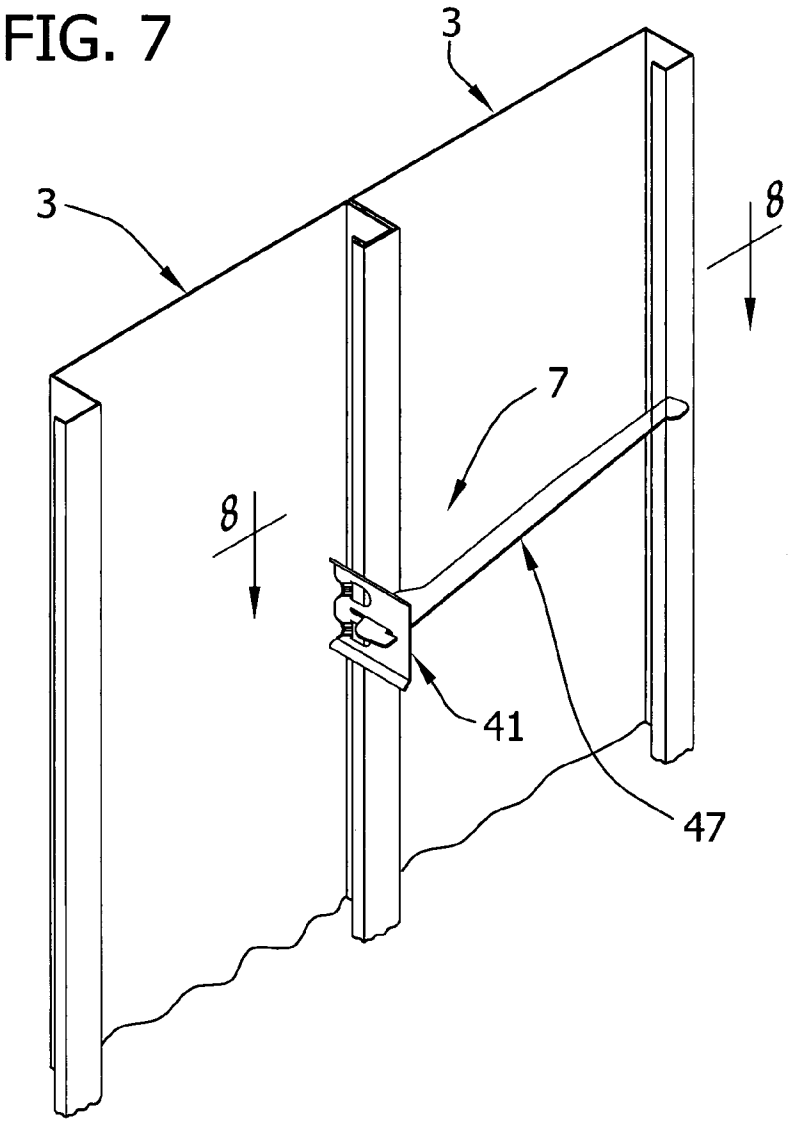

The lever 47 of the clamping device 7 is used to pivot the clamp 41 from the position shown in FIG. 6 in which the clamp is loosely applied to adjacent panels 3 in a position in which the panel engaging members 43 of the clamp underlie the overlapping lips 27, 33 of adjacent panels, to a clamping position (FIGS. 7-9) in which the clamping device 7 applies a clamping force to the overlapping flange portions (e.g., lips 27, 33) sufficient to securely hold them by friction resistance in fixed position relative to one another unless overcome by mine convergence or the like. The lever 47 also functions to retain the clamp 41 in its clamping position. In the embodiment shown in the drawings, the lever 47 comprises an elongate bar having a first head end 75 (FIG. 8) engageable with the clamp 41 and a second tail end 77 which forms a handle adapted to be grasped to pivot the clamp to its clamping position. The lever 47 may be formed from flat metal stock, for example, having a thickness less than the width of the slot 69 in the clamp 41 so that the head 75 of the lever can be inserted into the slot. It is contemplated that the lever could have other configurations and be attached to the clamp in other ways. For example, the lever could be hingedly connected to the clamp. Alternatively, the lever and clamp could be integrally formed.

In the illustrated embodiment, the head 75 of the lever 47 functions as a fulcrum and has a camming surface 79 comprising an edge 81 on the head 75 at one side of the head, and a notch 83 in a generally opposite side edge of the head. The head 75 of the lever 47 is adapted to be inserted into the slot 69 in the clamp plate 51 to a position in which the notch 69 in the lever head is generally aligned with slot, the slot edge of the plate 51 is received in the notch, and the camming surface 79 of the lever head is in contact with the overlapping flange portions (including lips 27, 33) of the panels (FIG. 6). The lever 47 is then pivoted about its head 75 in the plane of the lever to move the clamp to its clamping position (FIGS. 7 and 8) to yieldably lock the overlapping flanges together.

The length of the lever 47 is preferably such that when it is pivoted to move the clamp 41 to its clamping position, the tail (handle) end 77 of the lever can be placed under the adjacent in-turned flange portion(s) 25 of a respective panel, as shown for example in FIG. 8. This placement holds the lever 47 in a position in which the clamp 41 is retained in its clamping position. Advantageously, the handle end 77 of the lever 47 has a projection 89 thereon sized to fit in the space defined by the in-turned flange portion(s) 25 and corresponding lip(s) 27 of the panel to inhibit the unintentional release of the clamp 41 from its clamping position.

When the lever 47 is pivoted to move the clamp 41 to its clamping position, the force exerted by the clamp on the overlapping flange portions 25, 31, including the overlapping lips 27, 33, is preferably (but not necessarily) sufficient to deform the metal of the panels. In the embodiment illustrated in FIG. 9, the flanges (e.g., lips 27, 33) of the panels deform to match the curvatures of the curved surfaces 65 of the tongue-like members 43 of the clamp 41. Typically, the deformation will result in the bending of the lips 27, 33 in the area of the tongue(s) on the clamp, so that the metal is actually pushed into and possibly through the hole(s) 61 in the plate 51, as illustrated in FIG. 9, for example. As a result, the overlapping flange portions (e.g., lips 27, 33) are clamped securely together to lock adjacent panels in fixed side-by-side relation. Additionally, if the clamp 41 is placed at a location where the upper and lower panel members 11, 13 of one or both of the adjacent panels 3 overlap, then the clamp will also function to lock the upper and lower panel members of each such panel in fixed extended position relative to one another. Because metal is actually deformed during the clamping process, at least in the embodiment shown in FIG. 9, the upper and lower panel members 11, 13 of a panel 3 have a very high resistance contraction from their extended position relative to one another. This resistance is further enhanced if the lip 27 of first flange 19 extends closer to web 17 than lip 33 of the second flange 21 because the width differential results in increased friction between first flange 19 and second flange 21 when the clamp 41 is moved to its clamping position.

Experiments have shown, for example, that when the metal is deformed by a single clamp 41, the upper and lower panel members 11, 13 of a panel 3 will not contract until subjected to an axial force of 700 lbs. or more, compared to about 300 lbs. when a twist tie of the prior art systems is used. Nevertheless, in the event of a mine convergence involving massive forces, the upper and lower panels 11, 13 will contract to prevent permanent damage to the panel 3. During contraction of the panel members, the overlapping flanges 19, 21 of the panel move relative to one another and relative to the clamp 41. More specifically, the overlapping flanges slide over the curved surfaces 65 of the tongue-like members 43, causing metal in this area to deform as it moves into registration with the holes 61, and then to straighten as it moves out of registration with the holes. The curvature of these tongue-like members 43 reduces the risk of damage to the flanges 19, 21 during such movement. The clamping force exerted by the clamping device 7 is approximately the same before and after convergence.

In general, the configuration and location of the slot 69 in the clamp plate 51 and the camming surface 79 on the lever 47 should be such that the forces exerted by the lever on the clamp 41 fall short of the yield strength of the clamp. However, under some circumstances the forces may be such that the tongue(s) 43 will deform. It will be understood in this regard that the widths of the overlapping lips 27, 33 on the panel flanges 19, 21 may vary from panel to panel due, for example, to manufacturing tolerance and/or the type of metal used. If the widths are greater than normal, the tongue(s) 43 may actually yield (bend) to some extent, causing angle A (FIG. 8) to increase. This ability to yield is desirable because it allows for automatic accommodation of flanges of varying width.

Relatedly, the magnitude of the clamping force exerted by the clamp 43 will depend on various factors, including the size and contour of the camming surface 79, the size of the hole(s) 61 adjacent the tongue(s) 43, the extent of deformation (if any) of the tongue(s) and flange lips 27, 33 during clamping, and the material out of which the panel 3 is made. For example, if the flange lips 27, 33 are deformed into the hole(s) 61 in the clamping plate 51 during clamping, and the hole(s) is small (narrow in width), the flange material will deform and conform to the tongue radius more closely because it has to make a tighter turn in the opening. As a result, the clamping force exerted on the panels 3 will be higher. If the hole is wider, the flange material will not have to make as tight a turn, resulting in less resistance to movement and a reduction in clamping force. Further, if the panels 3 are made of a material of relatively low yield strength, the clamping plate 51 and tongue(s) 43 will tend to draw up tightly and cause the flanges 19, 21 to conform relatively closely to the radius of each tongue 43, thereby increasing clamping force. If the panel material has a higher yield strength, the clamp 41 may not be able to draw up tightly in which case the tongue(s) 43 will bend to increase angle A. In other words, as the pressure increases from the lever 47 being pivoted, the flange lips 27, 33 will either deform to meet the clamp or, failing that, the tongue(s) will bend to accommodate the stiffness of the flanges. In the preferred embodiment, the clamp 41 is stronger that the overlapping lips 27, 33 and flanges so that the lips will deform as the lever is pivoted. This deformation may be accompanied by some deformation of the tongue(s) 43 during the final stage of pivotal movement.

The exact shape, size and location of the tongue(s) 43, hole(s) 61 and slot 69 in the clamping plate 51 can vary without departing from the scope of this invention. The shape, size and location of the lever 47, camming surface 79 and notch 83 can similarly vary.

When adjacent panels 3 are secured together, the panels form a very strong yet lightweight structure. This is due in significant part to the overlapping portions of the panels, which in the illustrated embodiment are portions of the flanges 19, 21 along opposite sides of the panels, but which may take other forms. In whatever form they take, the overlapping potions of adjacent panels function to integrate the panels so that they act together as a single load-bearing unit as opposed to a plurality of individual and separate panels. Thus, loads applied to one or only a few panels of the panel system of the present invention are distributed to adjacent panels through the continuous overlapping flanges 19, 21, thereby effectively increasing the overall bending resistance of each panel and providing a structure which has an increased resistant to failure. It is worth noting in this regard that certain panels of a mine stopping are commonly anchored more securely than neighboring panels. This condition occurs because some of the panels 3 are invariably jacked into or against rocky projections in the mine roof that provide extraordinary anchorage compared to adjacent panels which may be installed in contact with roof sections that are relatively slick. In the present system of overlapping panels, those panels having extraordinary anchorage provide added support for adjacent panels having less anchorage, thereby producing a stopping which can withstand greater loads than previous designs. Significantly, this increase in strength is not at the cost of increased material. Indeed, by eliminating the horizontal angle bars of the prior systems described in the aforementioned patents, the panel system of the present invention consumes significantly less metal than the prior systems. Further, the overlap of the panels 3 inhibits leakage through the wall created by the panels. This is a substantial advantage over prior systems where panels are abutted side by side with no overlap.

A further advantage of the particular clamping device shown in the drawings is that the clamp 41 and lever 47 can be formed from the same material used to make other mine ventilation structures, such as mine doors and frame members, which may be made of sheet metal having a thickness about twice that of the panel material. As a result, if the fabrication of such equipment results in scrap material, such material can advantageously be used to make the clamp and lever at reduced cost.

Figure 11:
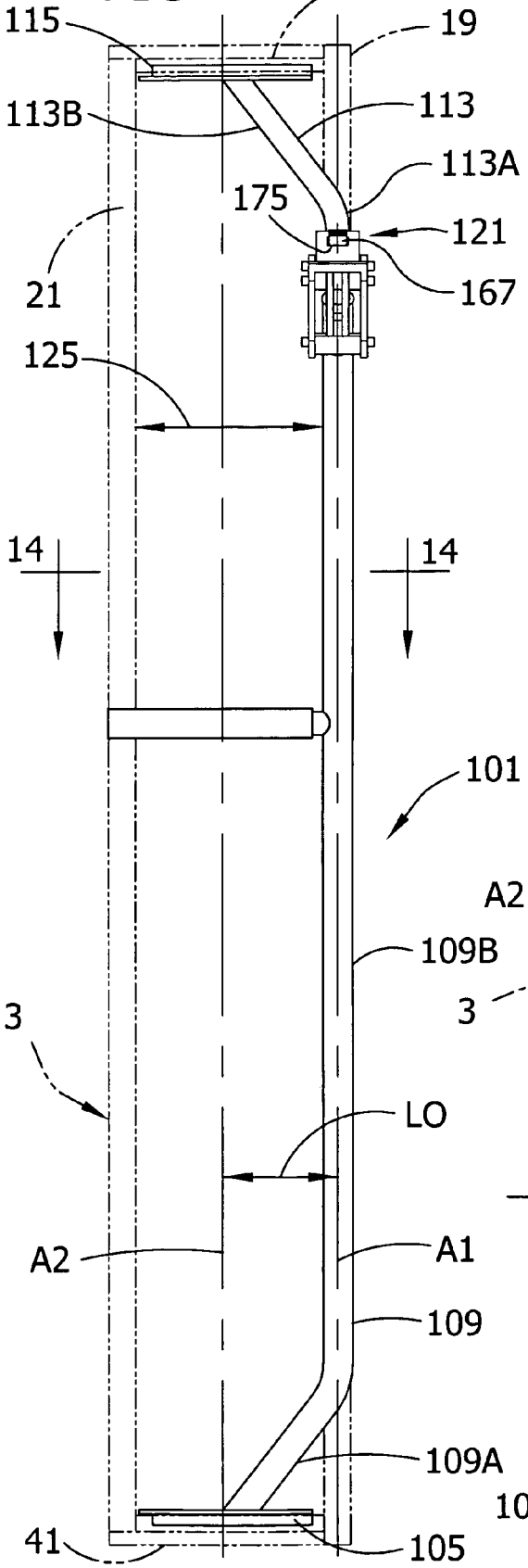
FIG. 11 is a front elevation of one embodiment of a jack of the present invention used to install the extensible panels, one of which is shown in phantom lines.
Figure 12:
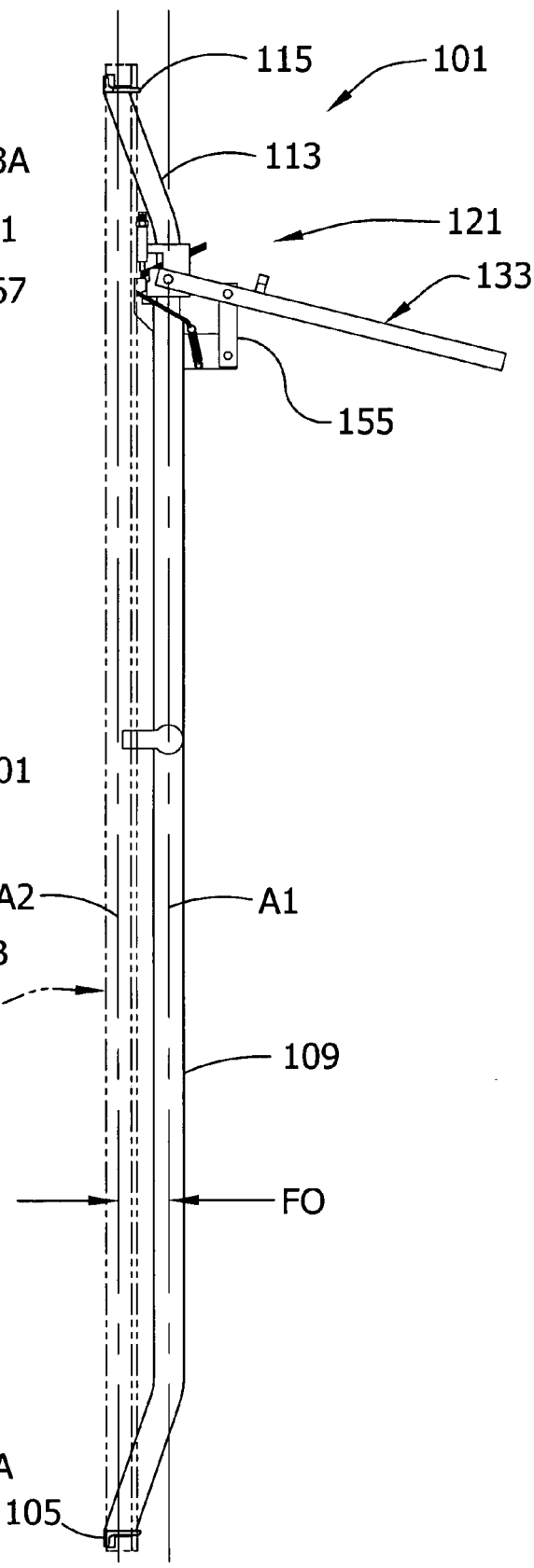
FIG. 12 is a side elevation of the jack shown in FIG. 11.

FIGS. 11 and 12 illustrate a jack, generally designated 101, for installing the extensible panels 3 in vertical side-by-side relation to form the stopping. As shown, the jack comprises a base 105 adapted to fit between the flanges 19, 21 at opposite sides of a lower panel member 11 and to engage the foot 41 of the lower panel member, a tubular guide 109 extending up from the base, and an extensible member 113 having an extensible fit with the guide. In one embodiment, the extensible member 113 is a tube having a sliding telescoping fit inside the guide 109. A support comprising an angle bar 115 is provided at the upper end of the extensible member 113 adapted to fit between the flanges 19, 21 of an upper panel member 13 and to engage the head 37 of the upper panel member. The jack 101 also includes an actuator, generally designated 121, for extending the extensible member 113 to move the support 115 into pressure engagement with the head 37 of the upper panel member 13 and the base 105 of the jack into pressure engagement with the foot 41 of the lower panel member 11. In this manner the upper and lower panel members 11, 13 can be extended relative to one another to bring the sealing member 39 in the head 37 of the upper panel member into sealing engagement with the roof R of the mine and the foot 105 of the lower panel member into general sealing engagement with the floor F of the mine (at least where the ventilation structure being constructed is a mine stopping).

As shown best in FIGS. 11 and 12, the guide 109 has a lower portion 109A which angles up from the base of the jack and a substantially vertical upper portion 109B. The extensible member 113 has a substantially vertical lower portion 113A which slidably telescopes in the upper portion 109B of the guide 109 and an upper portion 113B which angles up to the support 115. The configuration is such that when the jack 101 is positioned in a panel 3 for extending the upper and lower panel members 11, 13 relative to one another, the vertical telescoping portions of the guide and extensible member 109B, 113A are disposed adjacent one side of the panel 3 and forward of the panel to leave an area 125 (FIG. 11) between the first and second flanges 19, 21 of the panel 3 substantially unobstructed to permit the clamping devices 7 to be freely used. In other words, the axially aligned vertical telescoping portions of the guide and extensible member are laterally and forwardly offset with respect to the base 105 at the lower end of the jack and the support 115 at the upper end of the jack. The lateral offset is illustrated at LO in FIG. 11, where the offset corresponds to the distance between the axis A1 of the telescoping portions of the jack and the axis A2 through the centers of the support 115 and base 105 of the jack. The forward offset is illustrated at FO in FIG. 12. The magnitude of the lateral offset LO will vary, depending on the width (side-to-side) dimension of the panels 3; the magnitude of the forward offset FO will depend on the depth of the panel 3.

Figure 13:
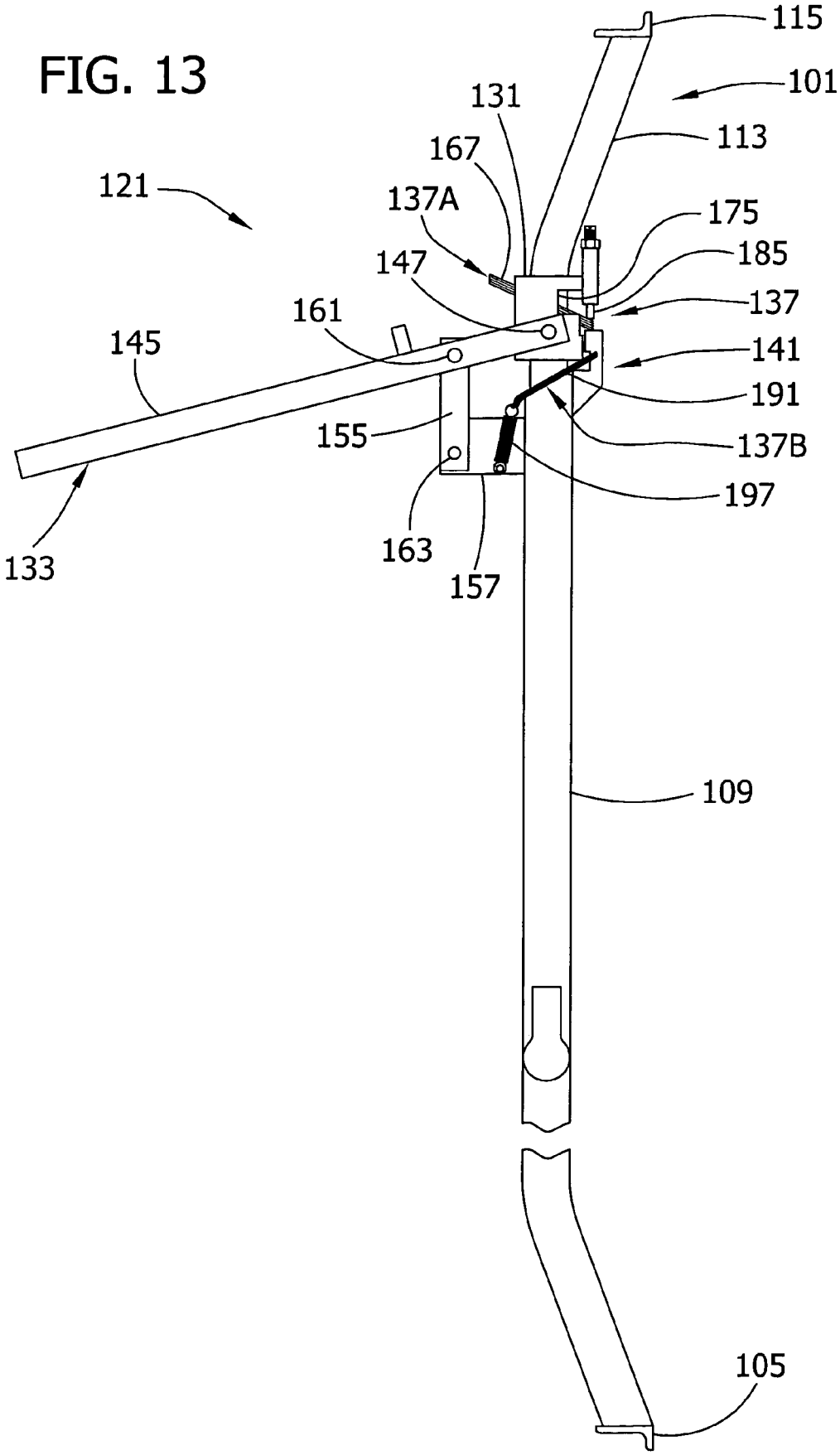
FIG. 13 is an enlarged side elevation showing an actuator of the jack.
Figure 14:
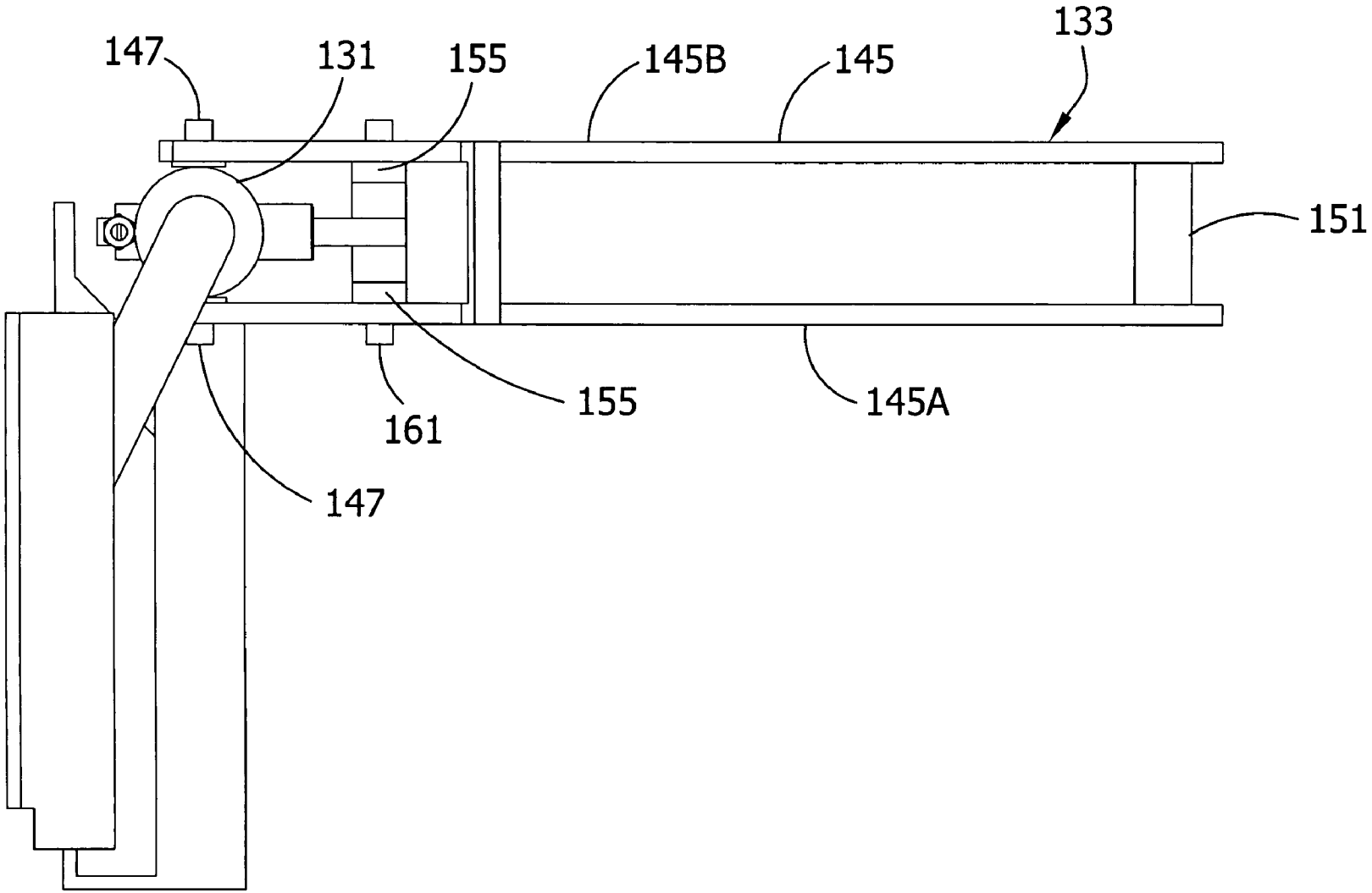
FIG. 14 is a top plan of the jack.

FIGS. 13 and 14 illustrate one embodiment of the actuator 121 of the jack 101. In this embodiment, the actuator 121 is a mechanical actuator comprising a first gripping mechanism 137A in the form of a sleeve or collar 131 (broadly "slider") movable up and down on the extensible member 113, a lever device generally designated 133 mounted on the guide 109 for movement through an extending stroke to extend (e.g., raise) the slider and through a retracting stroke to retract (e.g., lower) the slider, and a second gripping mechanism 137B on the guide for holding the extensible member 113 against retraction relative to the guide as the lever device is moved through a retraction stroke prior to the next extension stroke. The first gripping mechanism 137A and second gripping mechanism 137B collectively form a gripping system, generally indicated at 137. The actuator 121 also includes a quick-release mechanism, generally designated 141, for releasing the gripping system 137 to permit retraction of the extensible member 113 relative to the guide 109, thus collapsing the jack, without moving the lever device 133 through a series of strokes.

Referring to FIG. 14, the lever device 133 includes a lever arm 145 comprising a pair of parallel lever bars 145A, 145B pivoted at their forward ends on the slider 131 as indicated at 147 and connected at their rearward ends by a cross bar 151. A toggle linkage comprising a pair of toggle links 155 pivotally connects the lever arm 145 and a bracket 157 (FIG. 13) affixed to the guide 109, the pivot connection between the linkage and the lever arm being indicated at 161 and the pivot connection between the linkage and the bracket 157 being indicated at 163. The arrangement is such that pivotal movement of the lever arm 145 in a first direction (e.g., a downward pull on the lever arm) moves the lever device 133 through an extending stroke and pivotal movement of the lever arm in a second direction (e.g., an upward push on the lever arm) moves the lever device through a retracting stroke. The lever device may have other configurations. For example, to reduce cost and simplify the design, the lever arm may be a single lever bar and toggle link.

Figure 15:
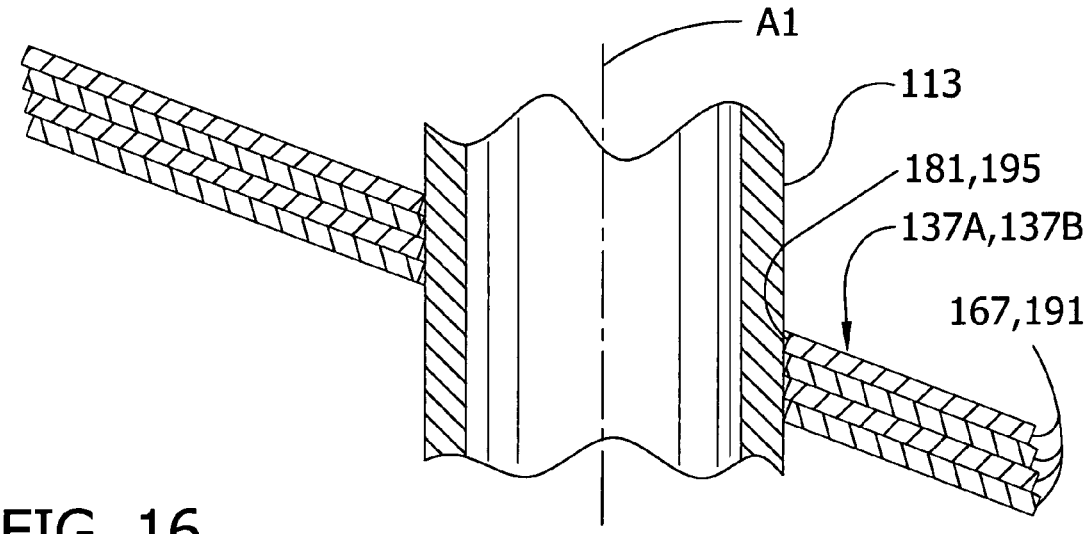
FIG. 15 is a view of a retainer of a gripping mechanism of the jack, the retainer being shown in an angled position for gripping an extensible member of the jack.
Figure 16:
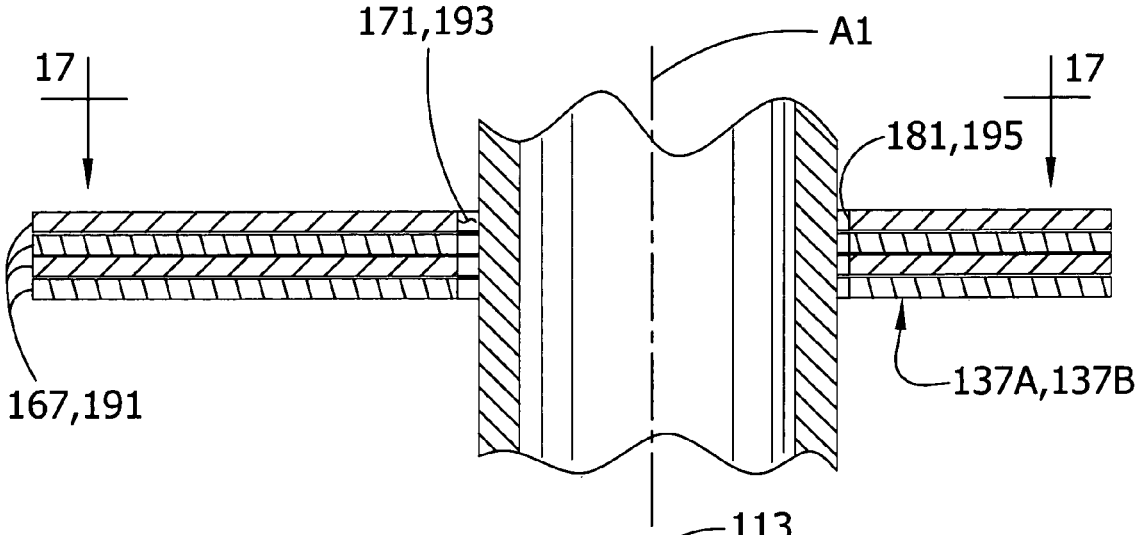
FIG. 16 is a view similar to FIG. 15 but showing the retainer in a non-gripping position.
Figure 17:
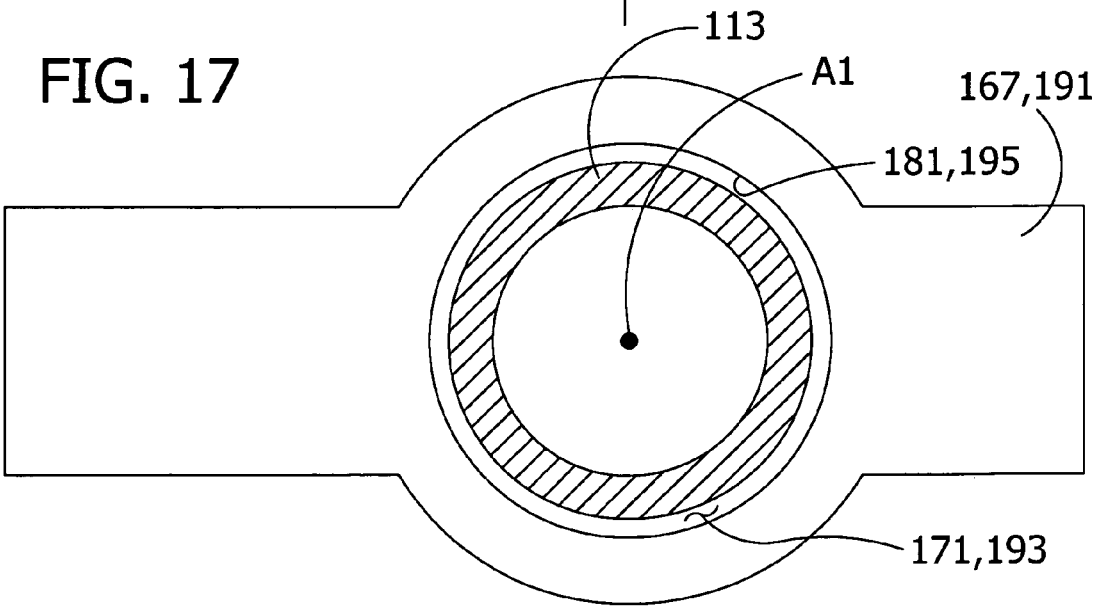
FIG. 17 is a section on 17-17 of FIG. 16.

In the embodiment shown in the drawings (e.g., FIG. 13), the gripping system 137 comprises a first gripping mechanism 137A for gripping the extensible member 113 during an extending stroke of the lever device 133 to extend the extensible member and for releasing the extensible member during a retracting stroke of the lever device. This mechanism 137A includes a retainer comprising one or more metal plates 167 (or other members) having openings 171 therein which receive the extensible member, four such plates being shown in FIGS. 13 and 15-17. The plates 167 extend through cutouts 175 in the slider 131 (FIGS. 11 and 13). The opening 171 in each plate 167 has an inner edge 181 (e.g., a circular inner edge) with an inside diameter greater than the outside diameter of the extensible member 113, and each plate is movable from a gripping position (FIG. 15) in which it is angled relative to a central axis A1 of the extensible member with its inner edge 181 in gripping contact with the extensible member during an extending stroke of the lever device 133, to a less angled, non-gripping position (FIG. 16) in which the inner edge 181 of the plate does not grip the extensible member 113 during a retracting stroke of the lever device 133. The retainer plates 167 are urged toward their gripping (angled) positions by a spring-biased pin 185 on the slider 131. The amount of force exerted by the spring 185 on the retainer 137A can be fixed or adjustable.

The gripping system 137 also includes a second gripping mechanism 137B (FIG. 13) which functions to hold the extensible member against retraction relative to the guide 109 as the lever device is moved through its retracting stroke prior to effecting another extending stroke. The second mechanism 137B is similar to the first 137A, comprising a retainer which includes one or more metal plates 191 (or other members) having openings 193 therein which receive the extensible member 113 at a location immediately adjacent the upper end of the guide 109, two such plates being shown in FIG. 13. The opening 193 in each plate has an inner edge 195, preferably circular, with an inside diameter greater than an outside diameter of the extensible member. The plates 191 are movable from an angled gripping position (FIG. 15) in which their inner edges 195 are angled relative to a central axis A1 of the extensible member 113 and in gripping contact with the extensible member during a retracting stroke of the lever device, to a less angled, non-gripping position (FIG. 16) in which the plates do not grip the extensible member during an extending stroke of the lever device 133. The plates 191 are urged toward their gripping position by a spring 197 connected at one end to the plates 191 and at its other end to the bracket 157.

Figure 18:
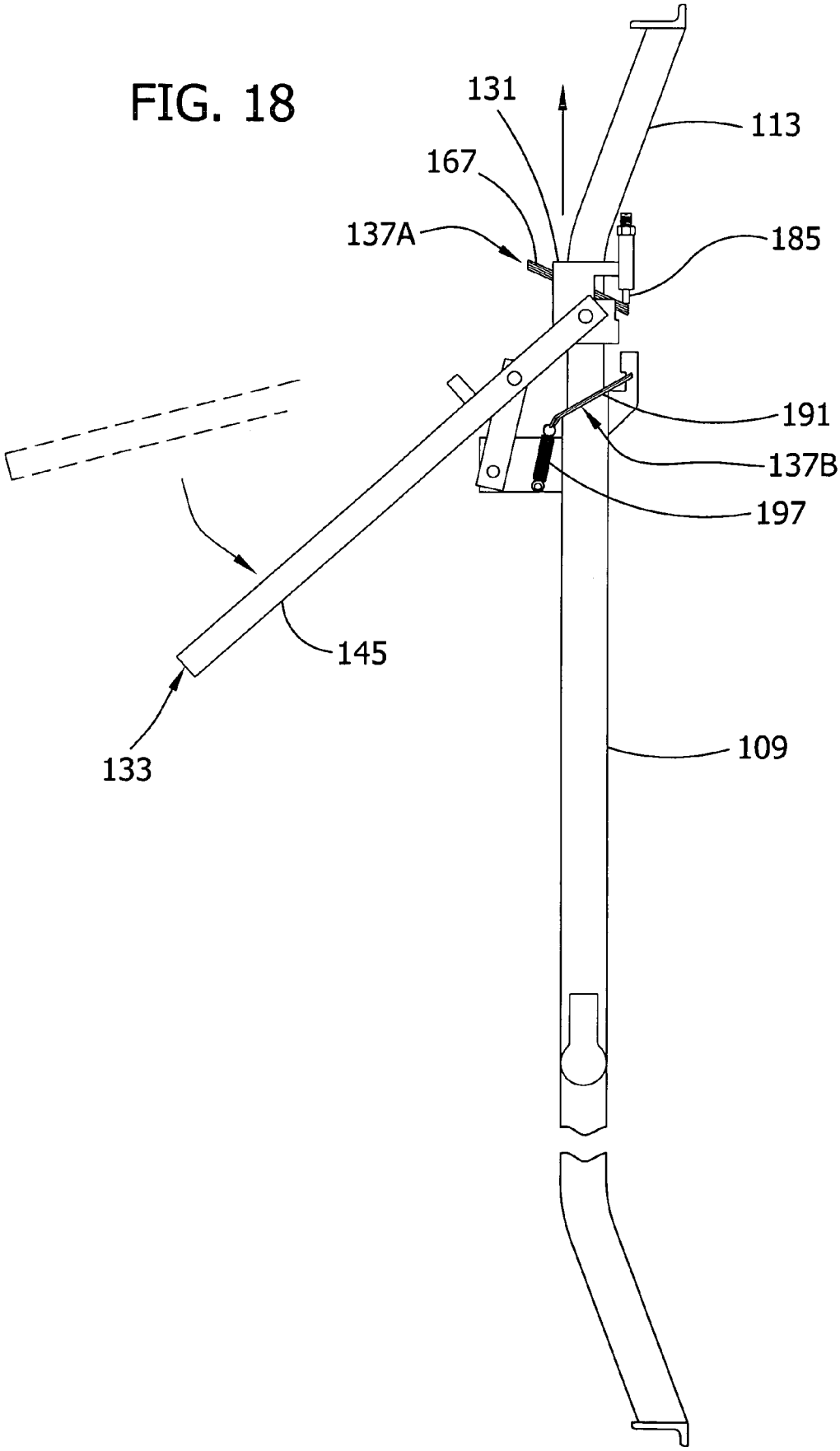
FIGS. 18-20 are sequential views illustrating operation of an actuator of the jack to extend the extensible member of the jack.
Figure 19:
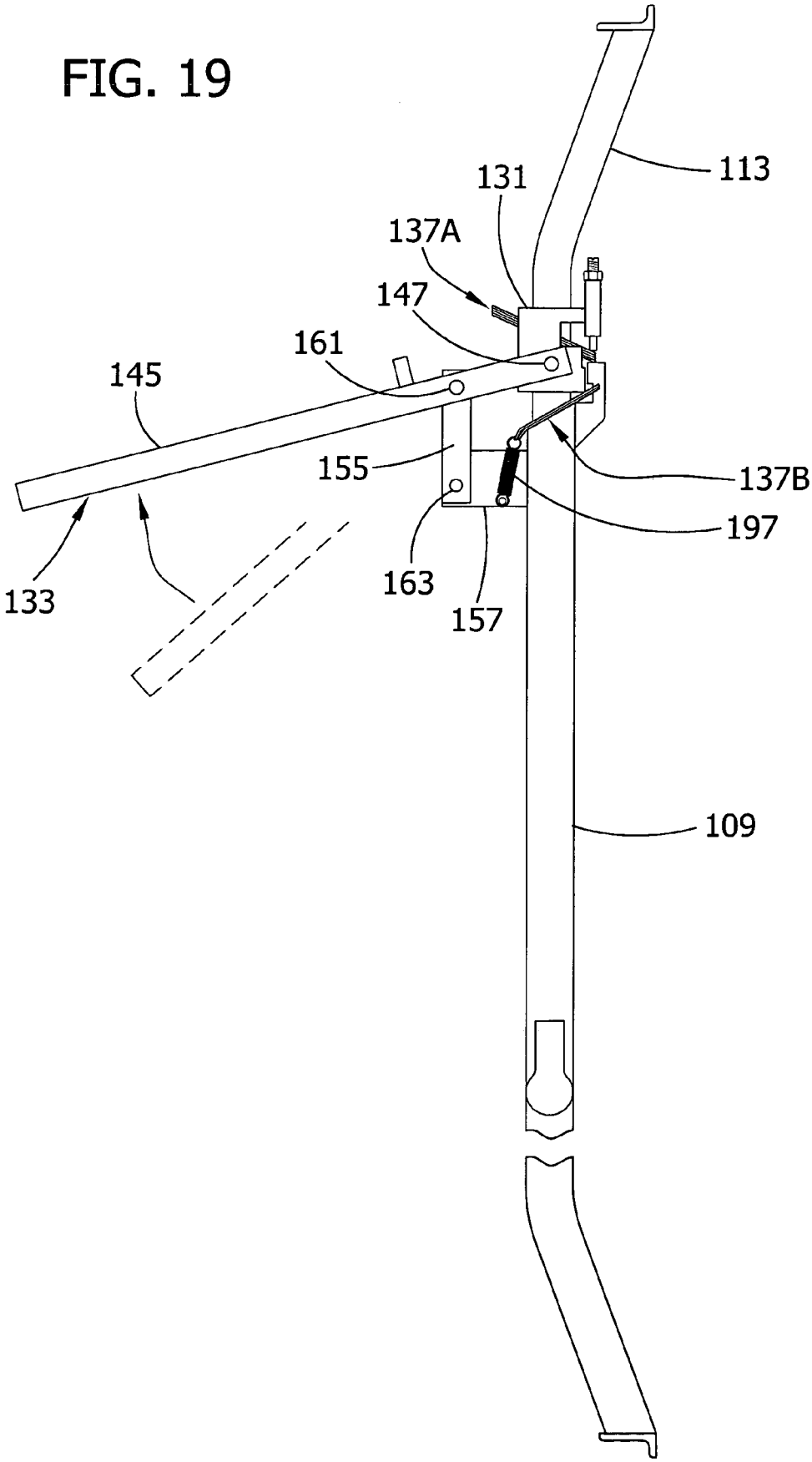

The arrangement is such that as the lever device 133 is moved (e.g., pulled down) through an extending stroke (see FIG. 18), the first gripping mechanism 137A on the slider 131 grips the extensible member 113 and extends (e.g., raises) it relative to the guide 109. After the stroke as been completed, the lever device 133 may be moved (e.g., pushed up as shown in FIG. 19) through a retracting stroke. During this stroke, the first gripping mechanism 137A automatically releases the extensible member 113 to permit downward movement of the slider 131, and the second gripping mechanism 137B automatically grips the extensible member and holds it against retraction down into the guide 109 prior to the next extending stroke. The second gripping mechanism 137B automatically releases the extensible member during an extending stroke.

Figure 20:
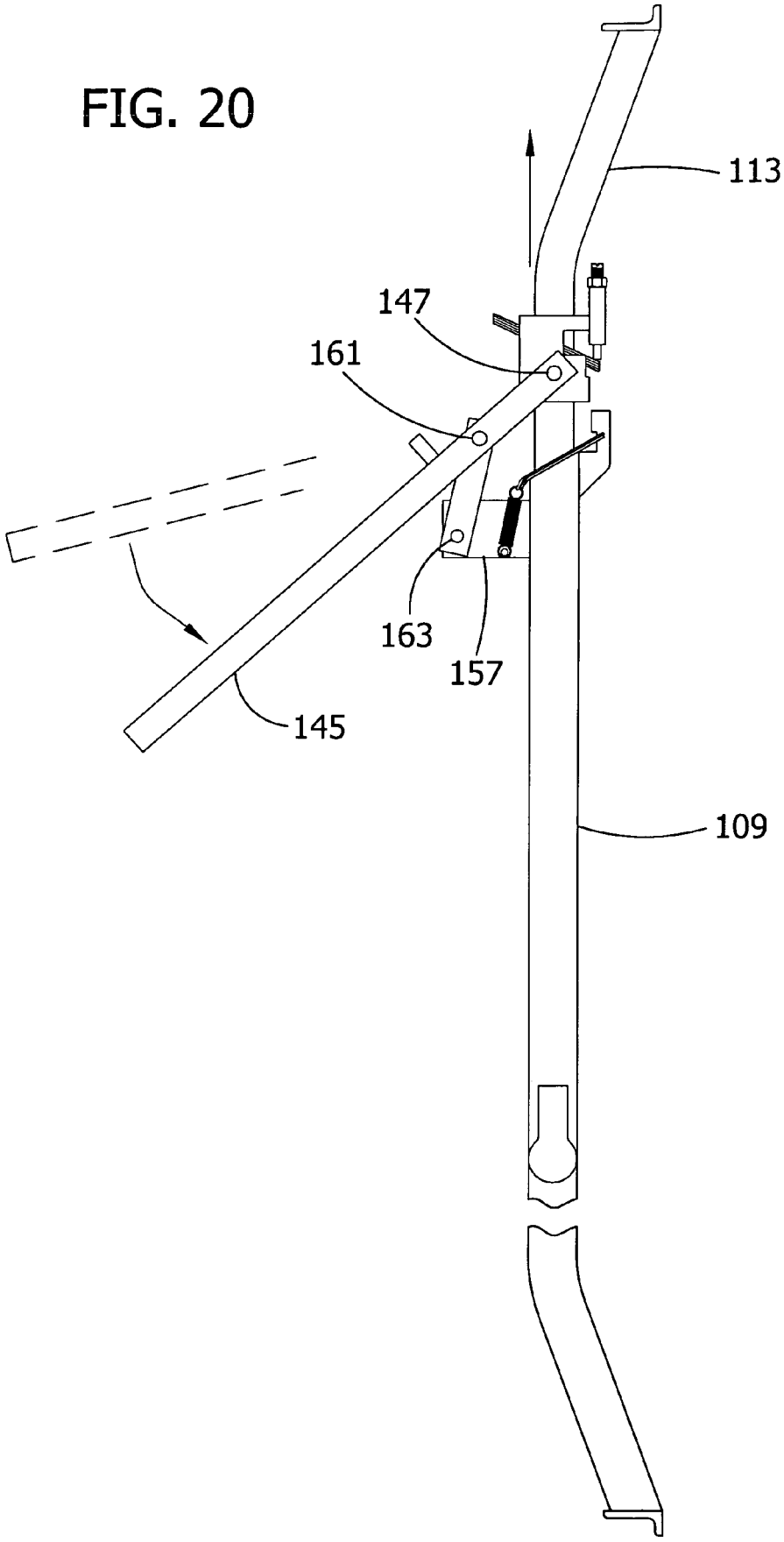
Figure 21:
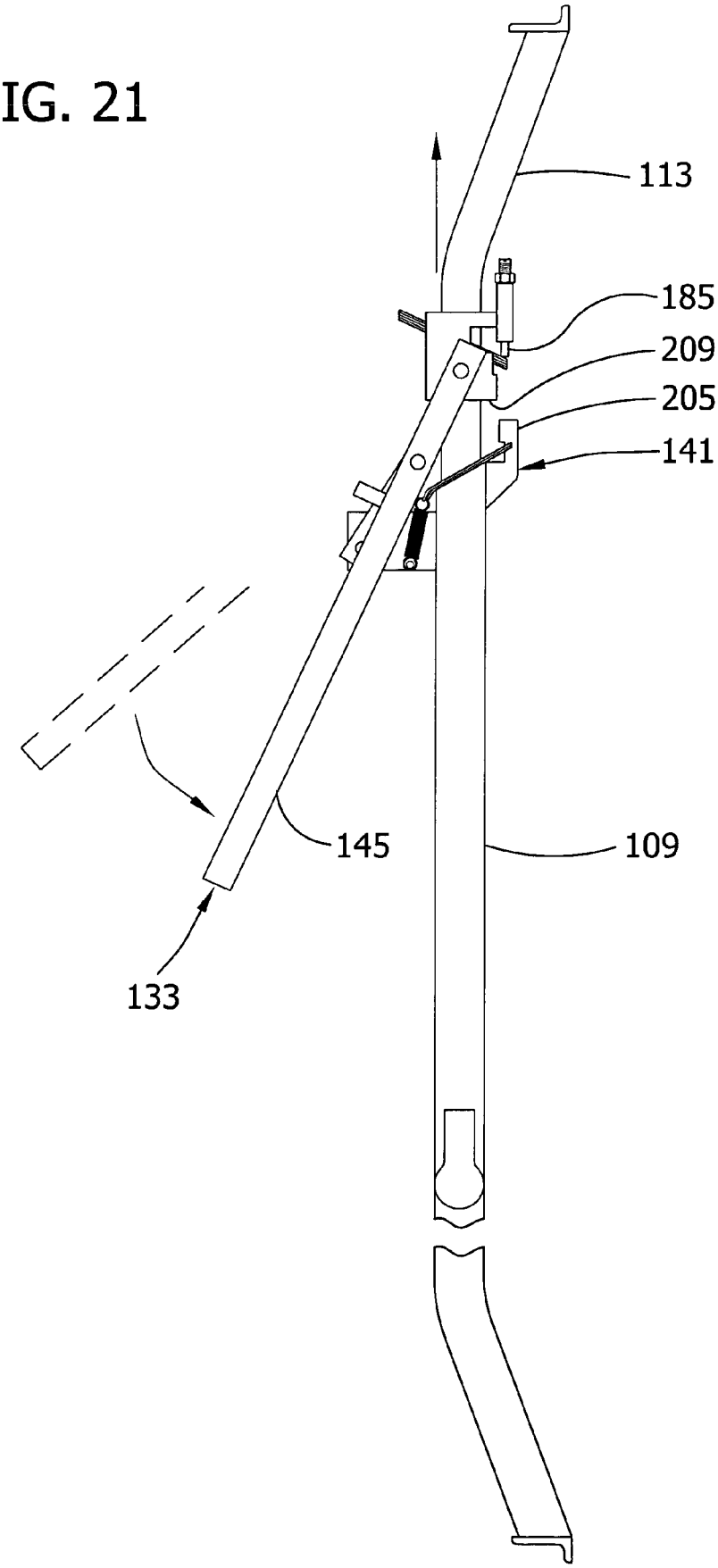
FIG. 21 is a view showing the actuator in an over-center position in which the extensible member is locked in position.

The geometry of the lever device 133 shown in the drawings is such that it exerts a varying axial (e.g., upward) force on the slider 131 during an extending stroke. During the initial (low-force) phase or range of a full extending stroke, when the pivot connections 147, 161, 163 between the slider 131, lever arm 145, toggle linkage 155 and guide bracket 157 are substantially out of alignment (FIG. 19), downward movement of the lever arm causes the slider to travel upwardly relatively rapidly but with less force. During the final (high-force) phase or range of the stroke, when the pivot connections 147, 161, 163 are more aligned (FIG. 20), downward movement of the lever causes the slider to travel up more slowly but with greater force. This arrangement is advantageous. For example, the panel 3 can quickly be extended up to the roof by pumping the lever arm 145 through a series of short partial strokes in the low-force range of movement. When more force is needed to press the panel into pressure engagement with the roof, the lever arm 145 can be pumped through a series of partial strokes in the high-force range of movement. As shown in FIG. 21, the lever arm can be locked in an over-center position at the end of a full extending stroke to hold the extensible member 113 extended relative to the guide.

Figure 22:
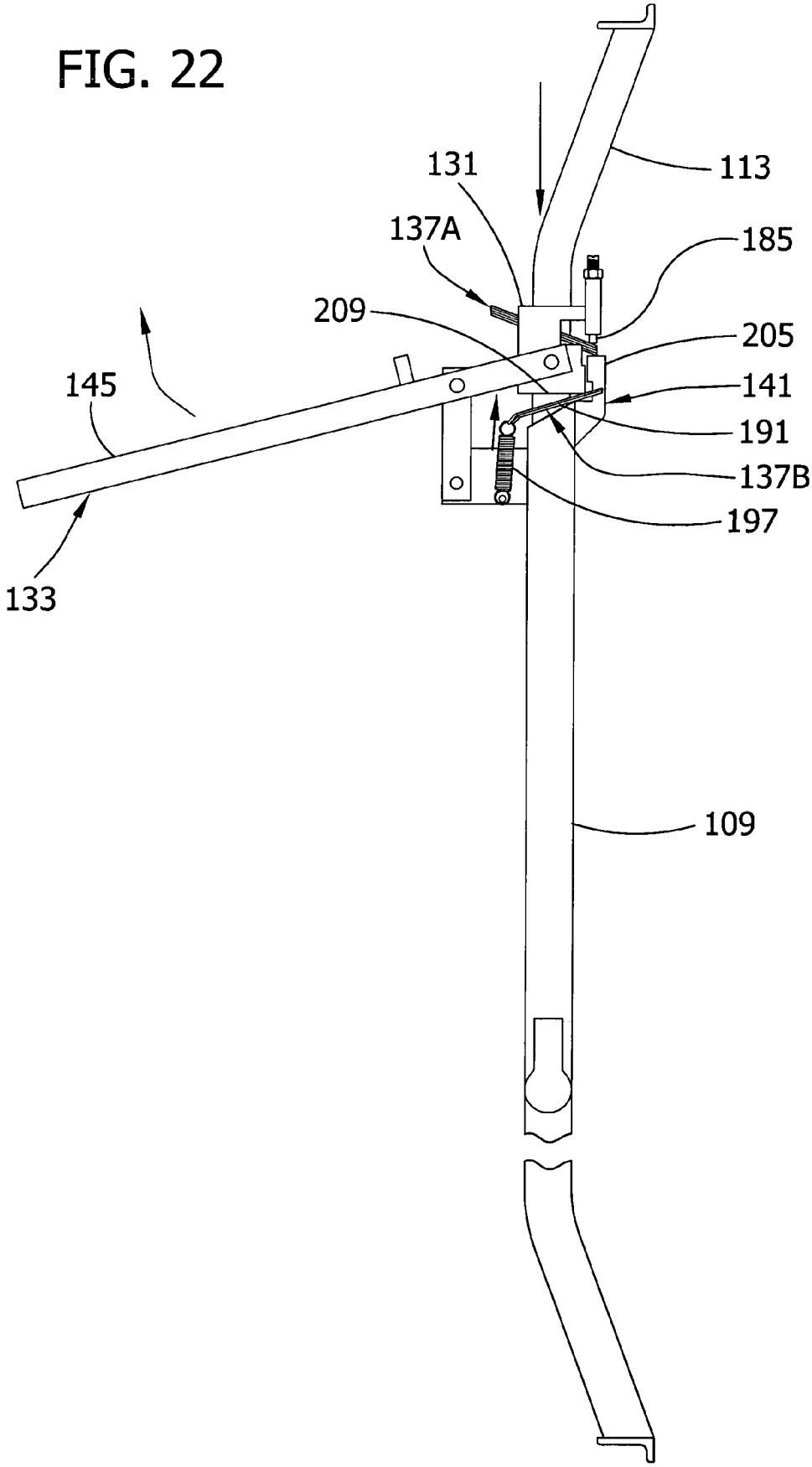
FIG. 22 is a view showing the actuator in a release position in which the extensible member is released to collapse the jack.

The release mechanism 141 is a quick-action mechanism used to disengage both gripping mechanisms to allow the extensible member to be retracted into the guide after a panel has been installed so that the jack can be quickly removed from the panel. The release mechanism 141 is operable by movement of the lever device 133 through a release stroke which, in one embodiment, is an extension of the movement of the lever arm through a retracting stroke. FIG. 22 illustrates movement of the lever device 133 through a release stroke in which the lever device is pushed up beyond the end of the retracting stroke. In this embodiment, the release mechanism comprises a release member 205 in the form of a finger on the guide 109 projecting beyond the upper end of the guide. When the lever device 133 is pushed through its release stroke, the finger 205 moves into contact with the retainer (e.g., formed by the retaining plates 167) of the first gripping mechanism 137A and holds it in its non-gripping position against the bias of the spring 185. Simultaneously, a release surface 209 on the first gripping mechanism 137A (at its lower end in FIG. 22) contacts the retainer (e.g., the retaining plates 191) of the second gripping mechanism 137B to move it to its non-gripping position against the bias of the spring 197. With both gripping mechanisms 137A, 137B held in their non-gripping positions, the extensible member 113 can be readily retracted into the guide 109 to collapse the jack so that it can be removed from the panel. The release mechanism can take other forms.

Figure 29:
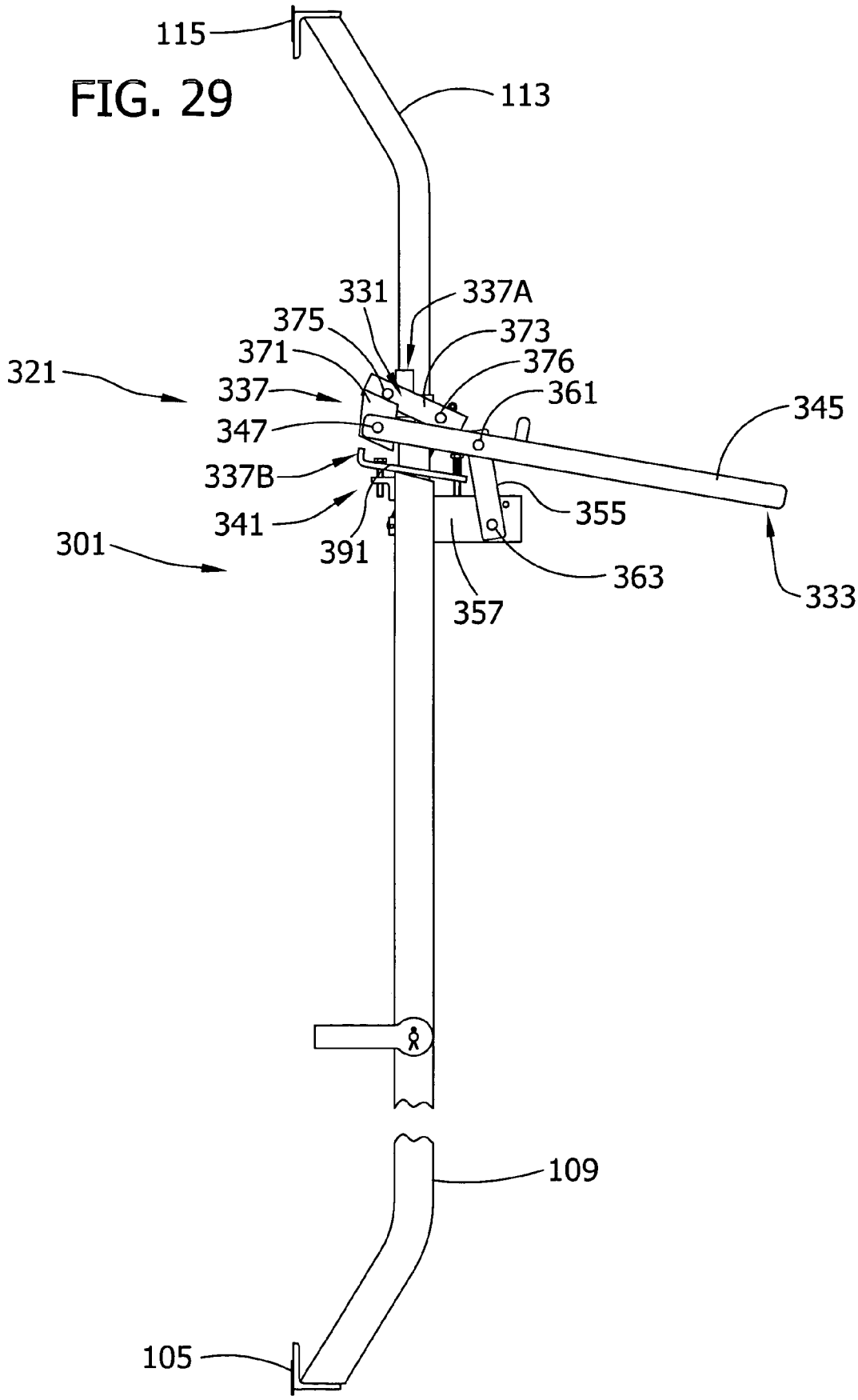
FIG. 29 is a side elevation of a jack of the present invention having an alternative actuator.
Figure 30:
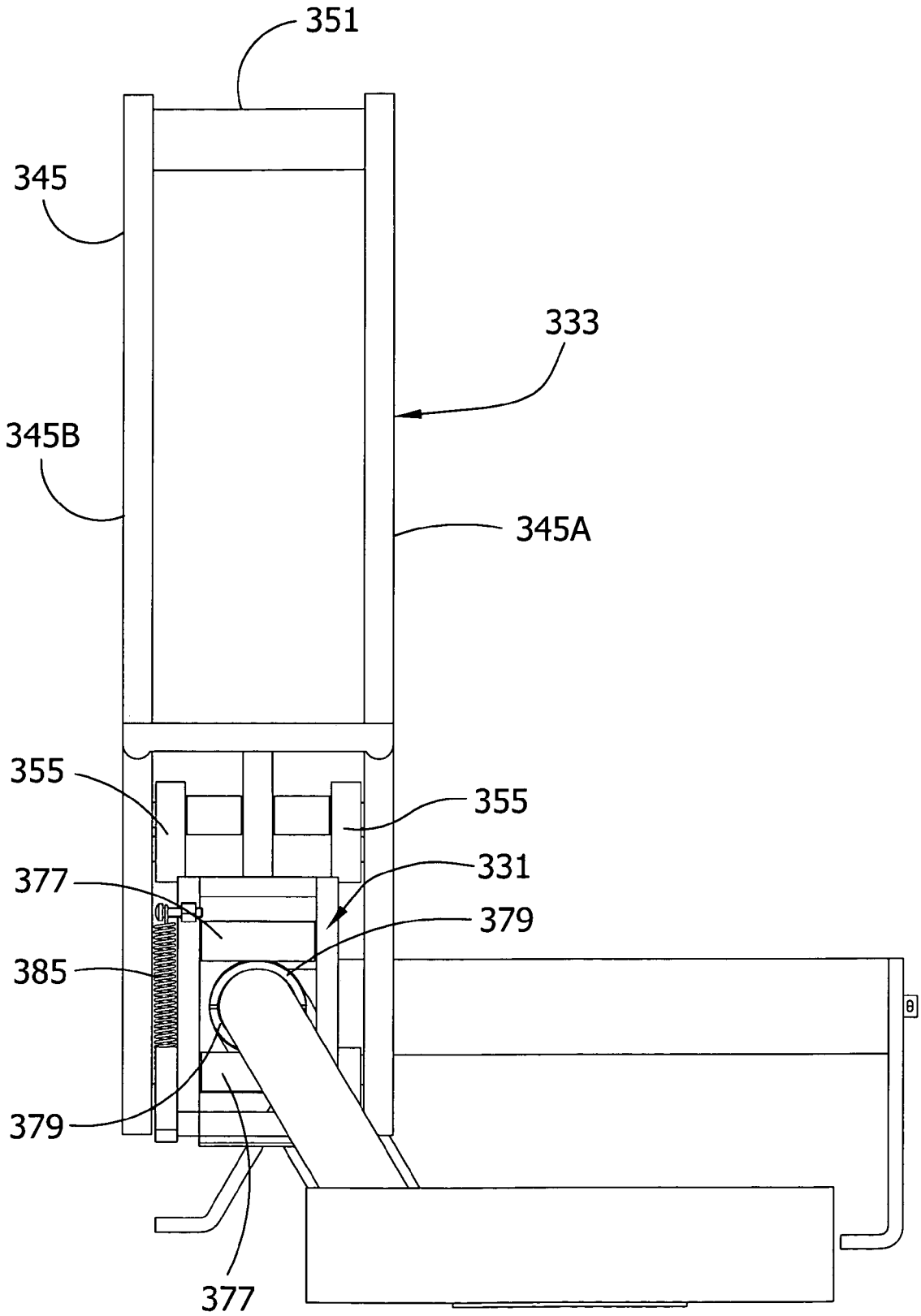
FIG. 30 is a top view of the jack shown in FIG. 29.

FIGS. 29 and 30 illustrate another embodiment of a mechanical actuator 321 of a jack 301 of the present invention which operates substantially in same manner as the previous described actuator 121 and jack 101. In this embodiment, the actuator 321 comprises a first gripping mechanism generally designated 337A in the form of a linkage generally designated 331 movable up and down on the extensible member 113, a lever device generally designated 333 mounted on guide 109 for movement through an extending stroke to extend (e.g., raise) the linkage 331 and through a retracting stroke to retract (e.g., lower) the linkage 331, and a second gripping mechanism generally designated 337B associated with the guide operable to hold the extensible member 113 against retraction relative to the guide as the lever device 333 is moved through a retraction stroke prior to the next extension stroke. The first gripping mechanism 337A and second gripping mechanism 337B collectively form a gripping system, generally indicated at 337. The actuator 321 also includes a quick-release mechanism, generally designated 341, for releasing the gripping system 337 to permit retraction of the extensible member 113 relative to the guide 109, thus collapsing the jack, without moving the lever device 333 through a series of strokes.

Still referring to FIGS. 29 and 30, the lever device 333 includes a lever arm 345 comprising a pair of parallel lever bars 345A, 345B pivoted at their forward ends on the linkage 331 as indicated at 347 and connected at their rearward ends by a cross bar 351. A toggle linkage comprising a pair of toggle links 355 pivotally connects the lever arm 345 and a bracket 357 affixed to the guide 109, the pivot connection between the linkage and the lever arm being indicated at 361 and the pivot connection between the linkage and the bracket 357 being indicated at 363. The arrangement is such that pivotal movement of the lever arm 345 in a first direction (e.g., a downward pull on the lever arm) moves the lever device 333 through an extending stroke and pivotal movement of the lever arm in a second direction (e.g., an upward push on the lever arm) moves the lever device 333 through a retracting stroke. The lever device may have other configurations. For example, to reduce cost and simplify the design, the lever arm 345 may be a single lever bar and toggle link.

Figure 31:
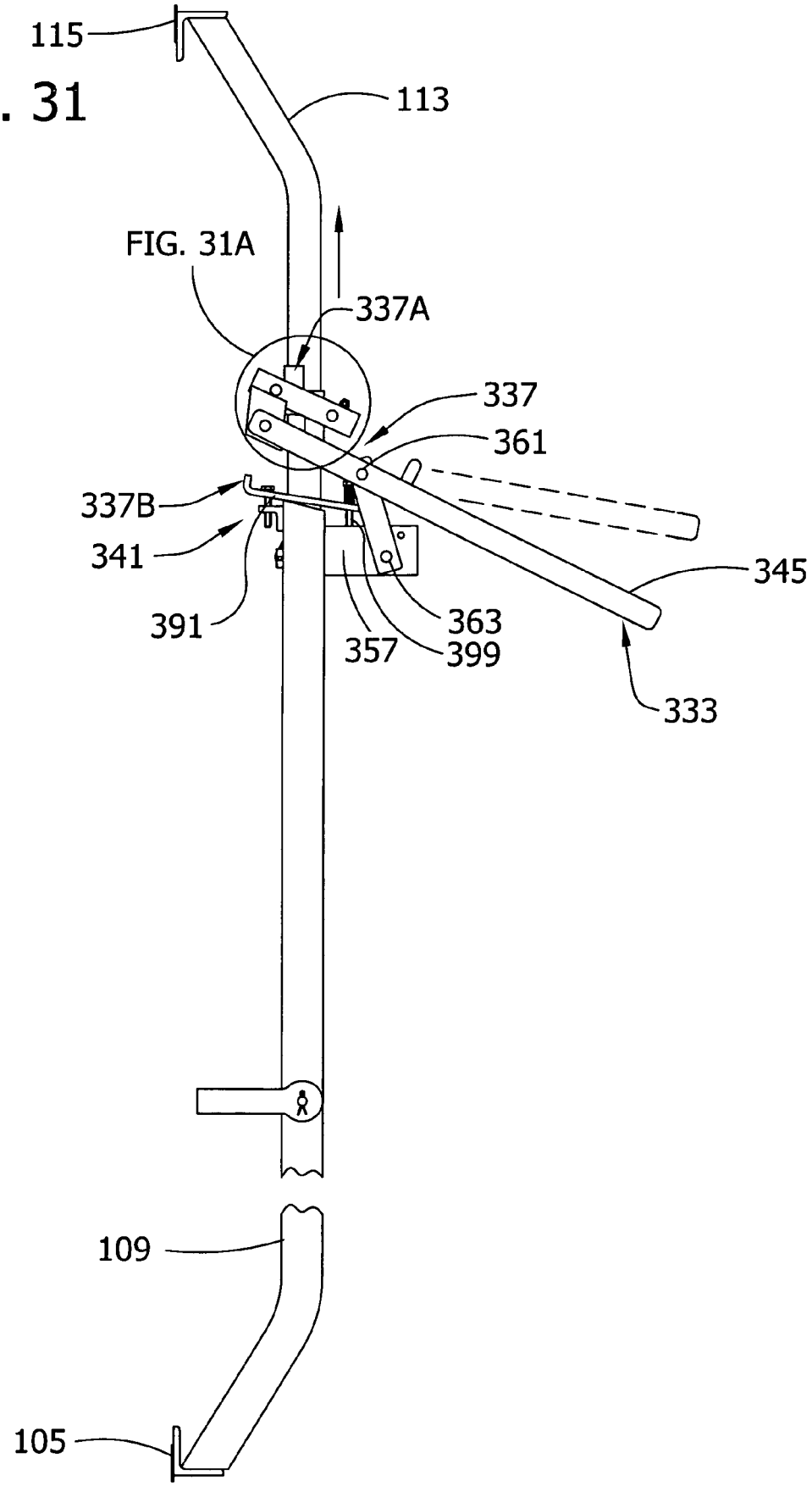
FIG. 31 is a side view showing the actuator in an extending stroke for extending an extensible member of the jack.
Figure 31A:
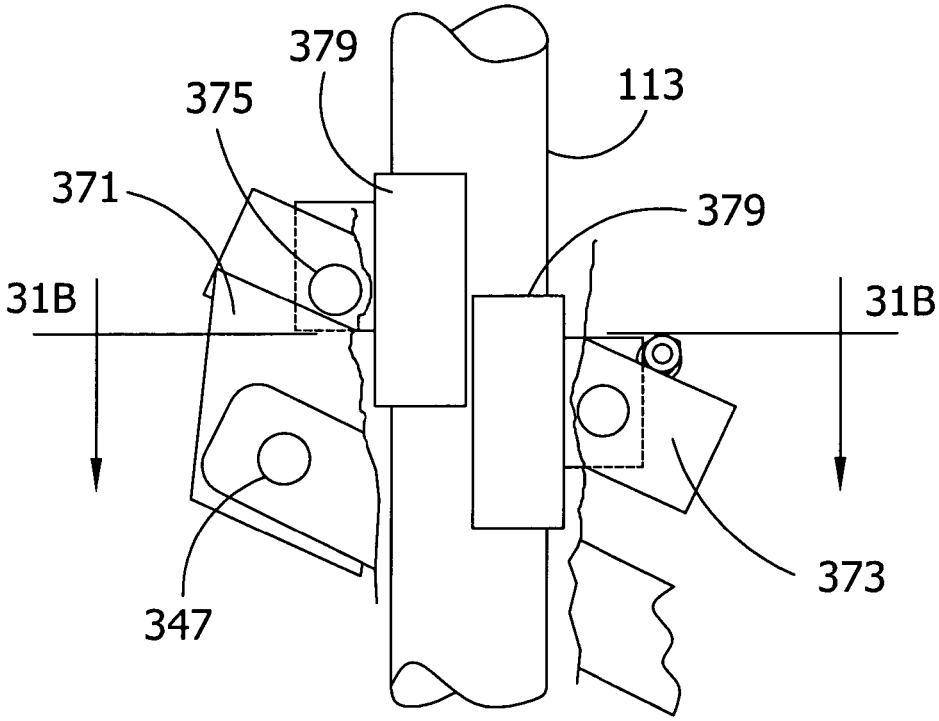
FIG. 31A is an enlarged view with parts broken away showing grippers of a gripping system gripping the extensible member.
Figure 31B:
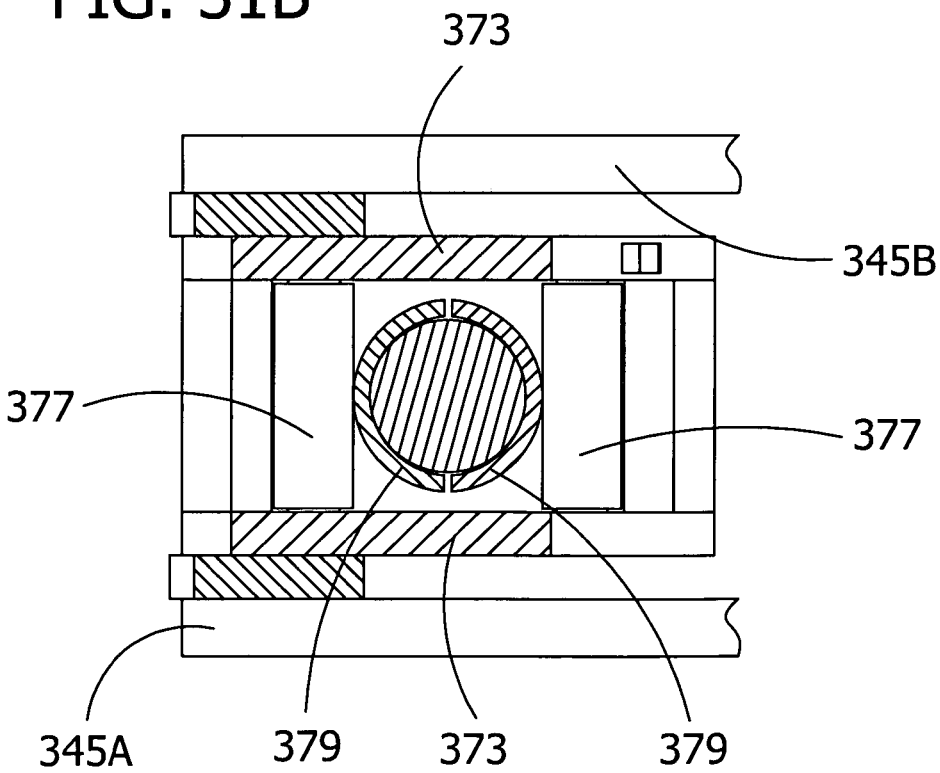
FIG. 31B is a section on 31-31 of FIG. 31A.

As shown in the drawings (e.g., FIG. 29), the linkage 331 includes two parallel, generally vertical links 371 attached at their lower ends by pivot connections 347 to respective lever bars 345A, 345B of the lever device 333, and two parallel rocker links 373 disposed above and extending generally in the same longitudinal direction as the lever device 333. Each rocker link 373 is pivotally attached at one end to an upper end of a respective vertical link 371 at pivot connection 375. As a result, the rocker links 373 are positioned adjacent extensible member 113. Two sleeves 377 (FIG. 30) span the spaced-apart rocker links 373 such that the links and the sleeves collectively form an opening for receiving the extensible member 113 therein. The sleeves 377 are secured between the rocker links by pins extending through each of the rocker links 373 and the sleeves. The pins are shown at pivot connections 375, 376. While the sleeves 377 are shown having a generally rectangular cross-section, other configurations such as a sleeve having a circular cross-section could be used without departing from the scope of this invention. Attached to each of the sleeves 377 is a gripper 379 for engaging the extensible member 113. The grippers 379 are positioned in opposed relation such that their inner surfaces face each other and the extensible member 113. In the embodiment shown in FIGS. 31A and 31B, each gripper is semi-cylindric and sized to generally conform to the outer surface of the extensible member 113 but other sizes and shapes are possible. In addition, one gripper or more than two grippers could be used without departing from the scope of this invention. The grippers 379 are movable by the linkage 331 from a gripping position (FIGS. 31, 31A and 31B) in which the inner surfaces of the grippers are in gripping contact with the extensible member during an extending stroke of the lever device 133, to a non-gripping position (FIGS. 32, 32A and 32B) in which the inner surfaces of the grippers do not grip the extensible member 113 during a retracting stroke of the lever device 133. The grippers 379 are urged toward their gripping positions by a spring 385 connected to one of the rocker links 373. The amount of force exerted by the spring 385 on the grippers 379 can be fixed or adjustable.

The arrangement is such that when the lever device 333 is moved (e.g., pulled down) through an extending stroke, the vertical links 371 are moved in an upward direction relative to the extensible member 113. As a result, the ends of the rocker links 373 attached to the vertical links 371, as well as the associated sleeve 377 and gripper 379, are also moved in an upward direction. The rocker links 373 pivot at pivot connection 375 causing the opposite ends of the links 373, as well as the opposite sleeve 377 and gripper 379, to move downward relative to the extensible member 113. This pivotal movement of the rocker links 373 reduces the horizontal distance between the grippers 379, thereby causing the inner surfaces of the grippers to engage and grip the extensible member 113.

When the lever device 333 is moved (e.g., pushed up) through retracting stroke, the vertical links 371 are moved in a downward direction relative to the extensible member 113. As a result, the ends of the rocker links 373 attached to the links 371, as well as the associated sleeve 377 and gripper 379, are also moved in a downward direction. The rocker links 373 pivot at pivot connection 375 causing the opposite ends of the links 373, as well as the associated sleeve 377 and gripper 379, to move upward relative to the extensible member 113. The pivoted movement of the rocker links 373 increases the horizontal distance between the grippers 379, thereby causing their inner surfaces to disengage the extensible member 113.

Figure 33:
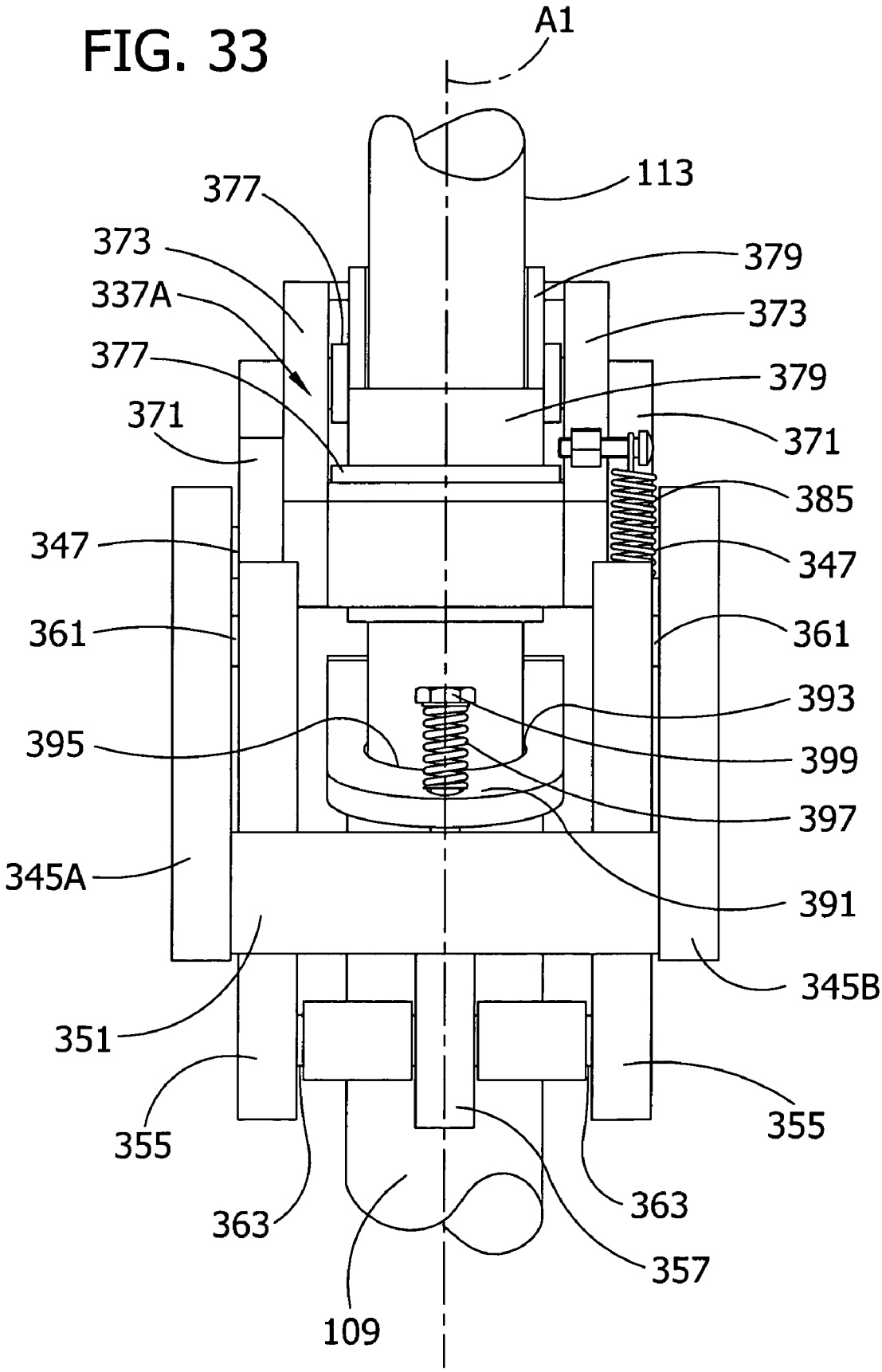
FIG. 33 is an enlarged front elevation of the actuator showing a retainer of the gripping system in a gripping position.

The gripping system 337 also includes a second gripping mechanism 337B (FIG. 29) which functions to hold the extensible member 113 against retraction relative to the guide 109 as the lever device 333 is moved through its retracting stroke prior to effecting another extending stroke. The second mechanism 337B comprises a retainer which includes a metal plate 391 (alternatively, two or more plates can be used) having an opening 393 therein which receives the extensible member 113 at a location immediately adjacent the upper end of the guide 109, one such plates being shown in FIG. 33. The opening 393 has an inner edge 395, preferably circular, with an inside diameter greater than an outside diameter of the extensible member. The plate 391 is movable from an angled gripping position (FIG. 33) in which the inner edge 395 is angled relative to the central axis A1 of the extensible member 113 and in gripping contact with the extensible member during a retracting stroke of the lever device, to a less angled, non-gripping position (FIG. 31) in which the plates do not grip the extensible member during retraction of the jack. The plate 391 is urged toward the gripping position by a spring 397 secured by a bolt 399 fixed on the bracket 357.

The arrangement is such that as the lever device 333 is moved (e.g., pulled down) through an extending stroke (see FIG. 31), the first gripping mechanism 337A on the linkage 331 grips the extensible member 113 and extends (e.g., raises) it relative to the guide 109. After the stroke as been completed, the lever device 333 may be moved (e.g., pushed up as shown in FIG. 29) through a retracting stroke. During this stroke, the first gripping mechanism 337A automatically releases the extensible member 113 to permit downward movement of the linkage 331, and the second gripping mechanism 337B automatically grips the extensible member and holds it against retraction down into the guide 109 prior to the next extending stroke. Accordingly, the extensible member 113 can be selectively extended any desired distance (limited only by the length of the extensible member) by moving the lever device 333 through a continuous series of extending and retracting strokes.

Figure 34:
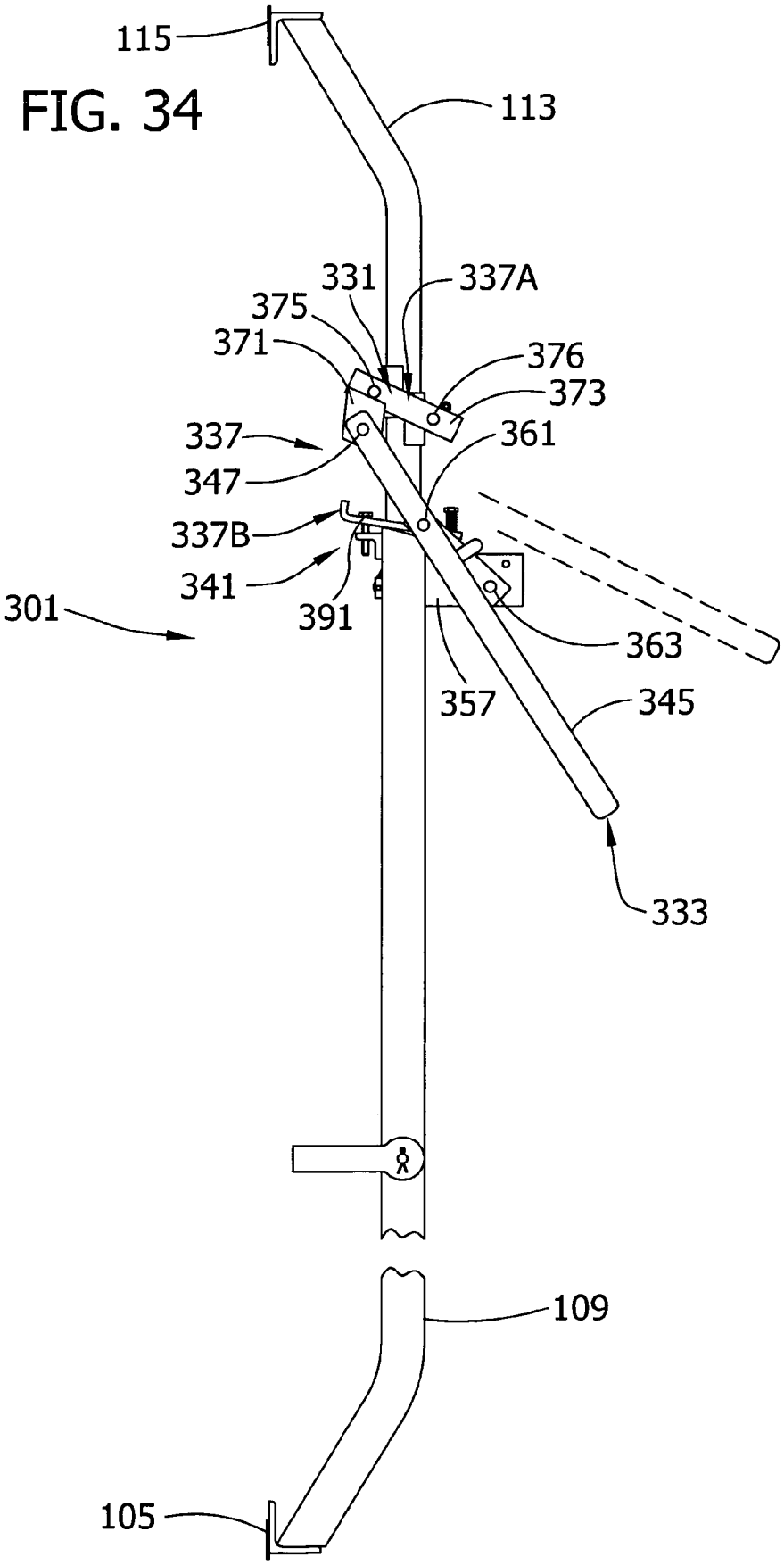
FIG. 34 is a view showing the actuator in an over-center position in which the extensible member is locked in position.

The geometry of the lever device 333 is similar to the prior described lever device 133 such that it too exerts a varying axial (e.g., upward) force on the linkage 331 during an extending stroke. As shown in FIG. 34, the lever arm can also be locked in an over-center position at the end of a full extending stroke to hold the extensible member 113 extended relative to the guide.

Figure 32:
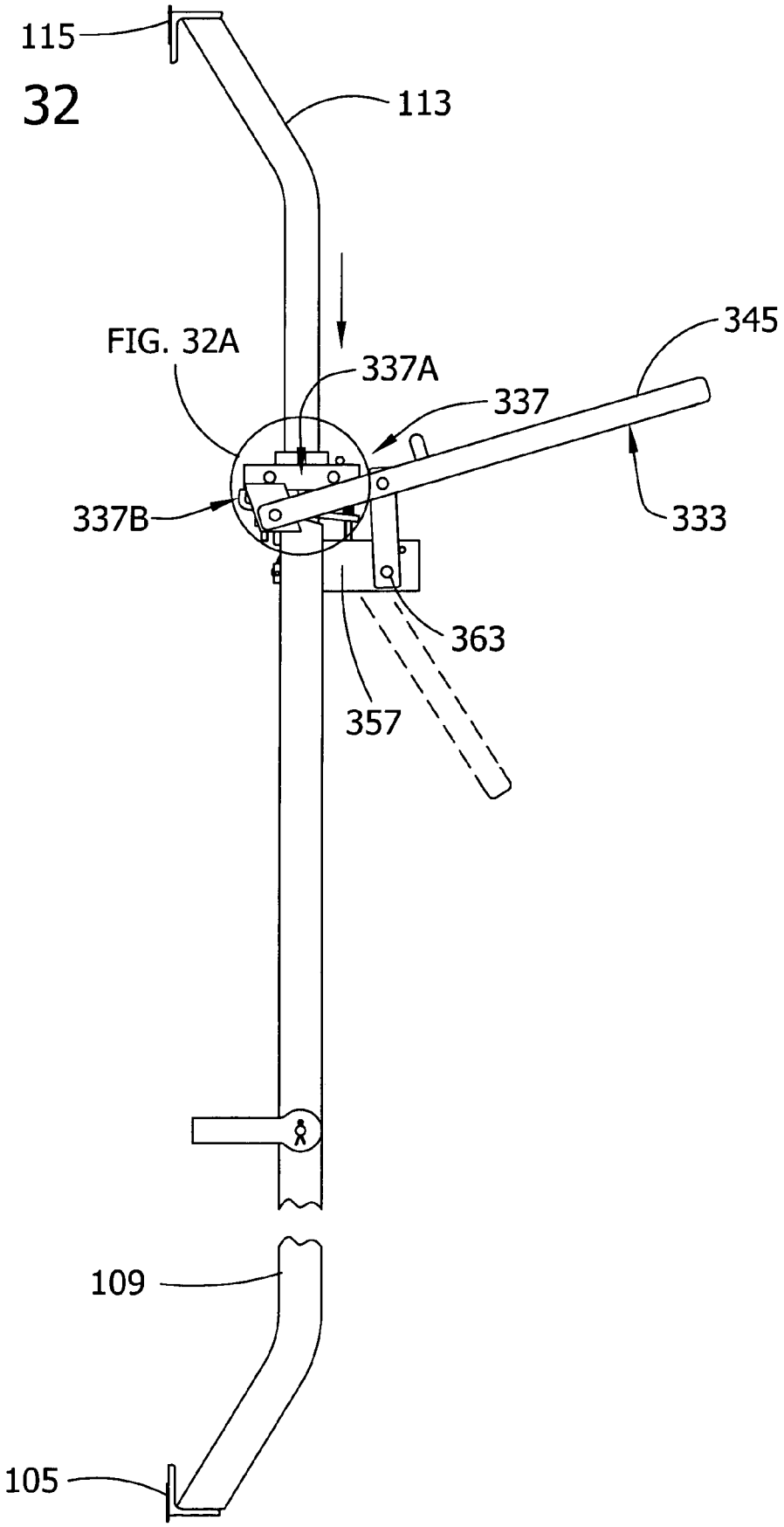
FIG. 32 is a view showing the actuator in a release position in which the extensible member is released to collapse the jack.
Figure 32A:
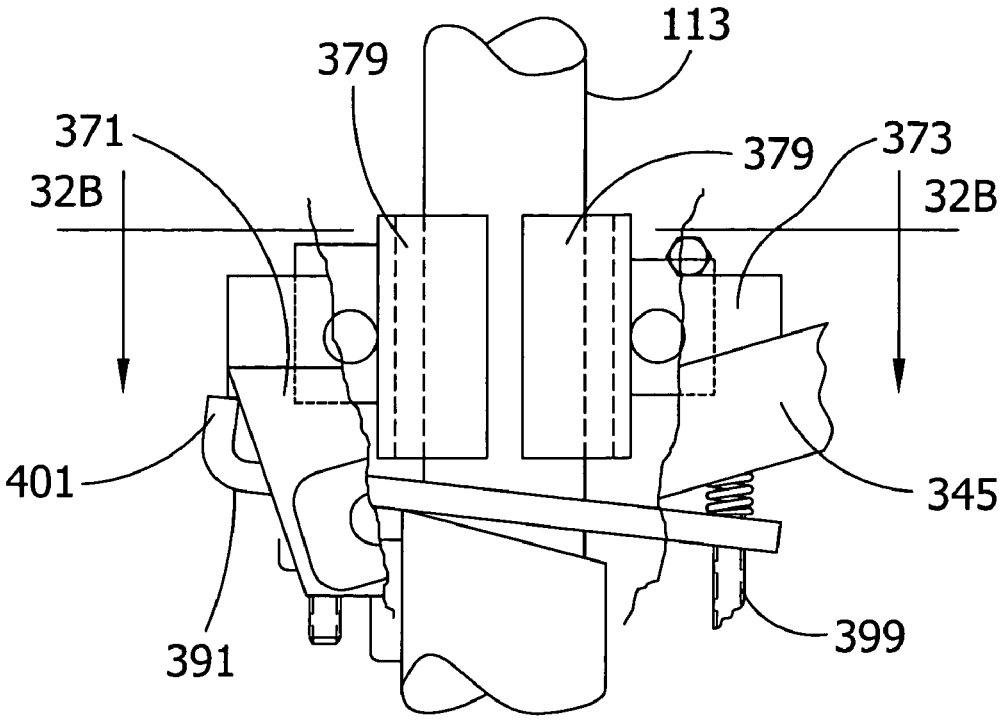
FIG. 32A is an enlarged view with parts broken away showing the grippers of the gripping system in a non-gripping position.
Figure 32B:
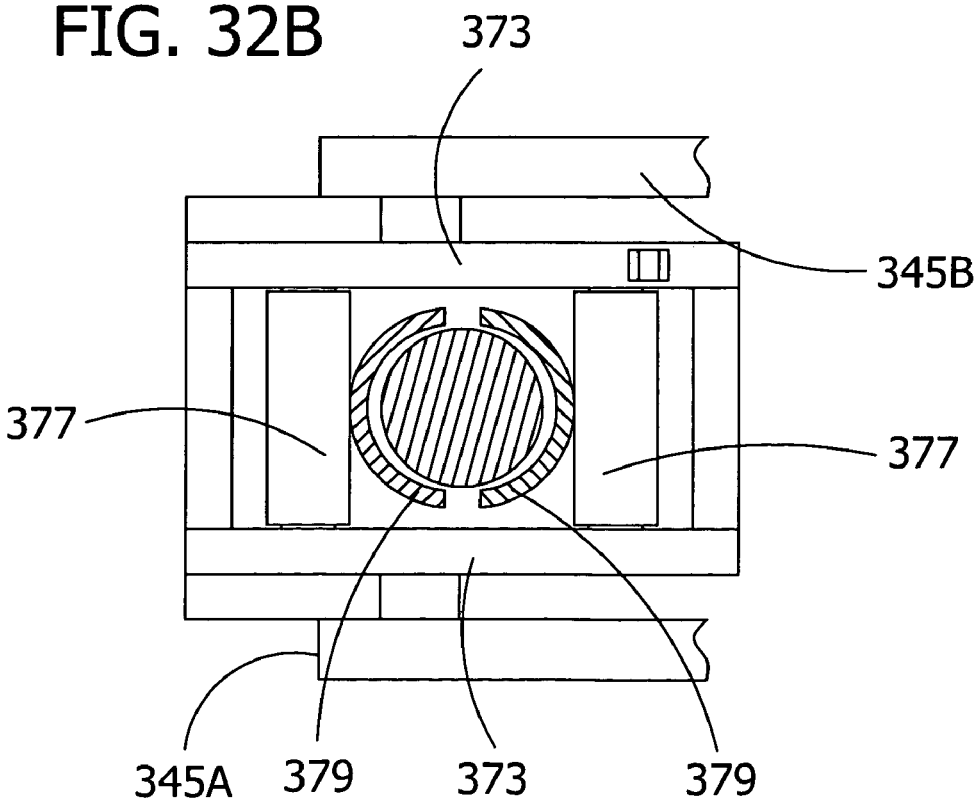
FIG. 32B is a section on 32-32 of FIG. 32A.

The release mechanism 341 is a quick-action mechanism used to disengage both gripping mechanisms to allow the extensible member to be retracted into the guide after a panel has been installed so that the jack can be quickly removed from the panel. The release mechanism 341 is operable by movement of the lever device 333 through a release stroke which is an extension of the movement of the lever arm through a retracting stroke. FIGS. 32, 32A and 32B illustrate movement of the lever device 333 through a release stroke in which the lever device is pushed up beyond the end of the retracting stroke. In this embodiment, the release mechanism comprises a lip 401 (FIG. 32A) on plate 391 for contact with one of the sleeves 377. When the lever device 333 is pushed through its release stroke, the sleeve 377 moves into contact with the lip 401 of the plate 391 of the second gripping mechanism 337B and holds it in its non-gripping position against the bias of the spring 397. With both gripping mechanisms 137A, 137B in their non-gripping positions, the extensible member 113 can be readily retracted into the guide 109 to collapse the jack so that it can be removed from the panel.

As described above, the base 105 of the jack engages the foot 41 of the panel and the support 115 at the upper end of the extensible member engages the head 37 of the panel. However, it will be understood that this arrangement could be reversed without departing from the scope of this invention (i.e., the base could engage the head and the support could engage the foot).

Figure 26:
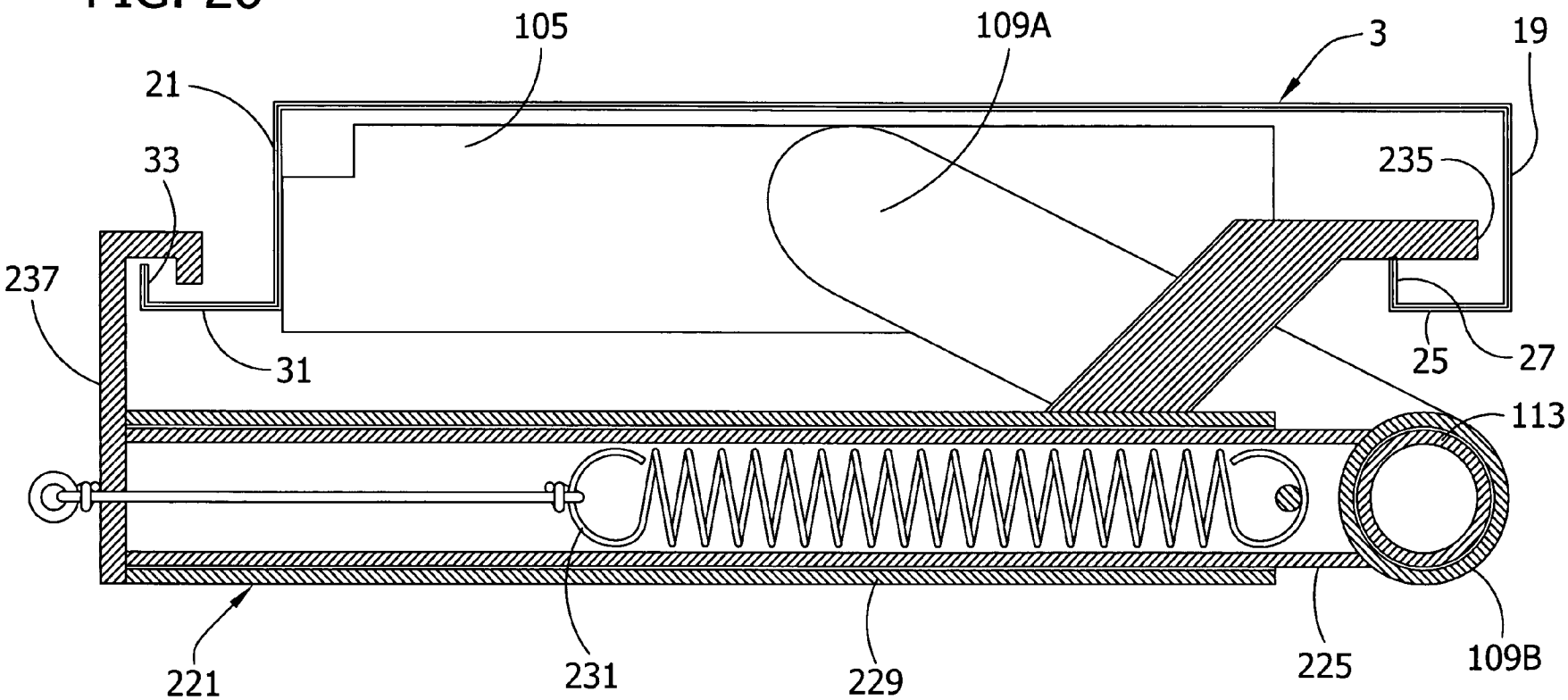
FIG. 26 is a section on 26-26 of FIG. 25.

Advantageously, a handle, generally designated 221, is attached to the guide 109 and is engageable with the panel 3 when the support 115 and base 105 of the jack 101 are positioned adjacent respective end pieces 37, 41 to facilitate transport and handling of the jack and the panel as a unit. The handle 221 extends laterally from the guide 109 and is equipped for releasable engagement with the flanges 19, 21 of a panel to be installed. In one embodiment (FIGS. 23-26), the handle 221 comprises a first (inner) generally cylindric handle member 225 affixed as by welding to the upper portion 109B of the guide 109 generally at a height convenient for handling by an installer, a second (outer) handle member 229 which is preferably tubular and axially slidable on the outside of the first handle member 225 for telescoping movement relative to the first handle member from a retracted position (FIG. 23) to an extended position (FIG. 24), and a spring mechanism 231 (FIG. 26) which urges the second handle member 229 toward its retracted position. The handle 221 has a pair of holders 235, 237, the first (235) being engageable with the in-turned flange 19 of a panel 3 and the second (237) being engageable with the out-turned flange 21 of the panel. In one embodiment, the first holder 235 is generally finger-shaped and the second holder 237 is generally J-shaped, and both are affixed to the outer handle member 229 which is rotatable relative to the inner handle member 225.

Figure 23:
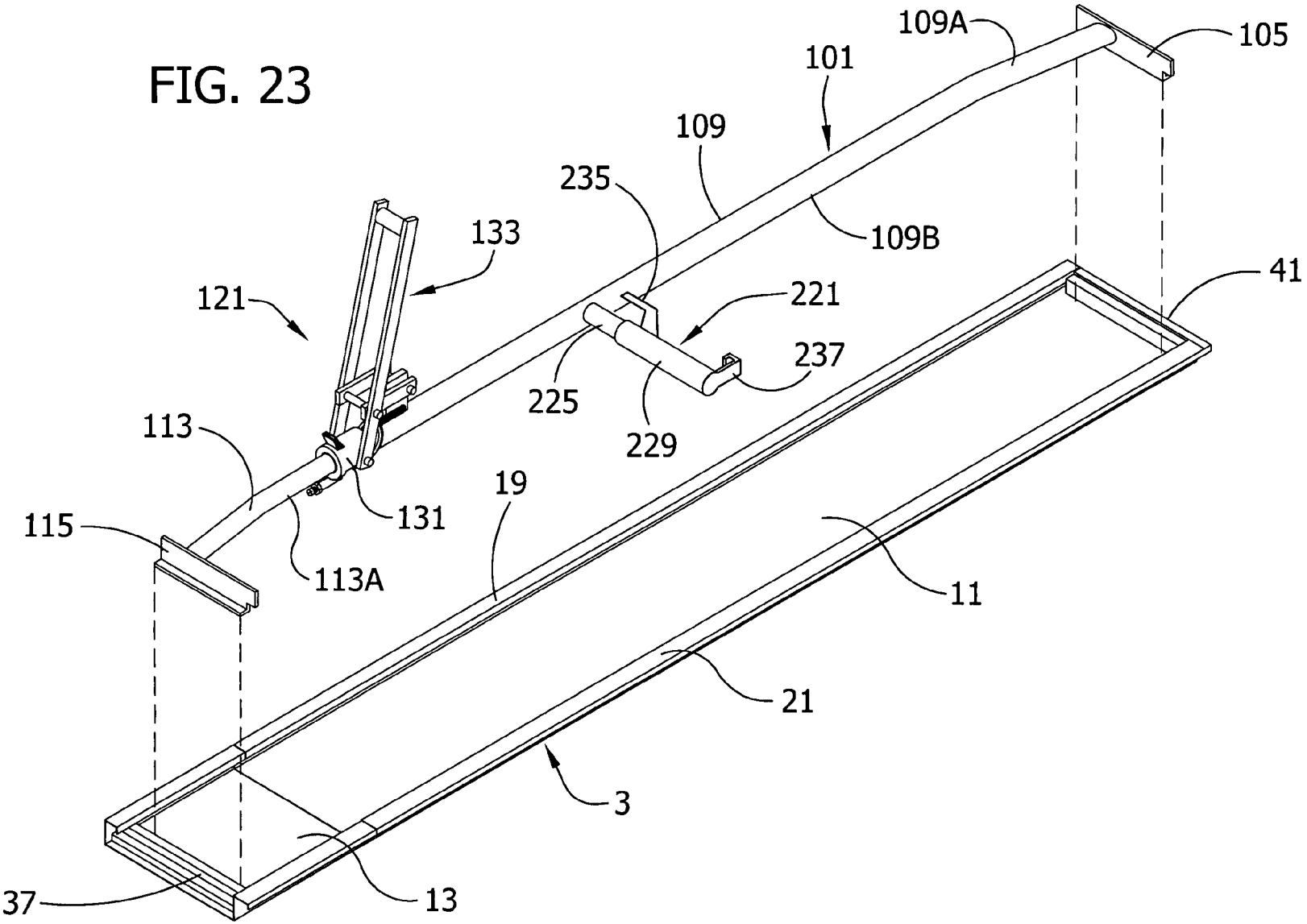
FIGS. 23-25 are views illustrating how the jack may be used to carry an extensible panel.
Figure 24:
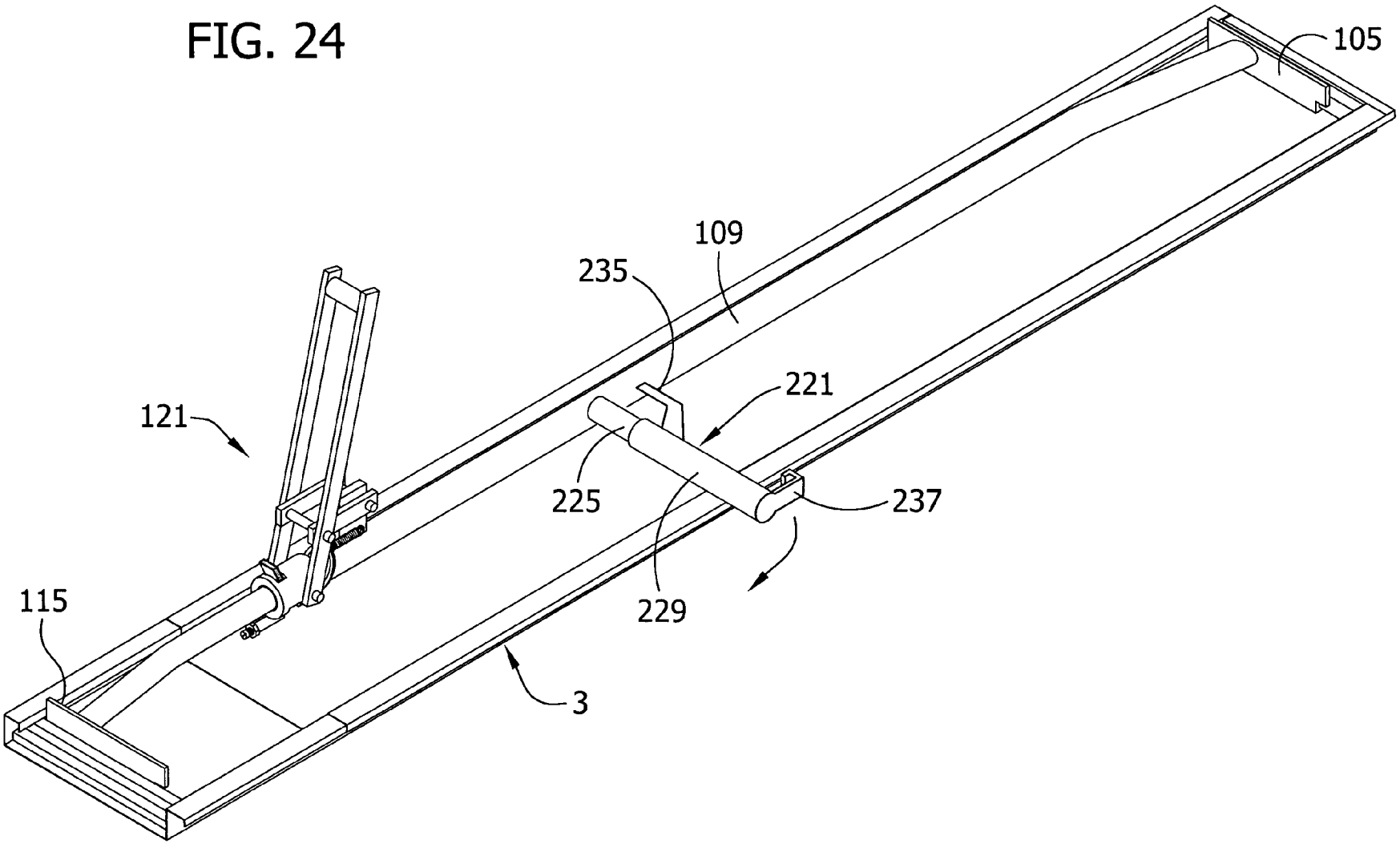
Figure 25:
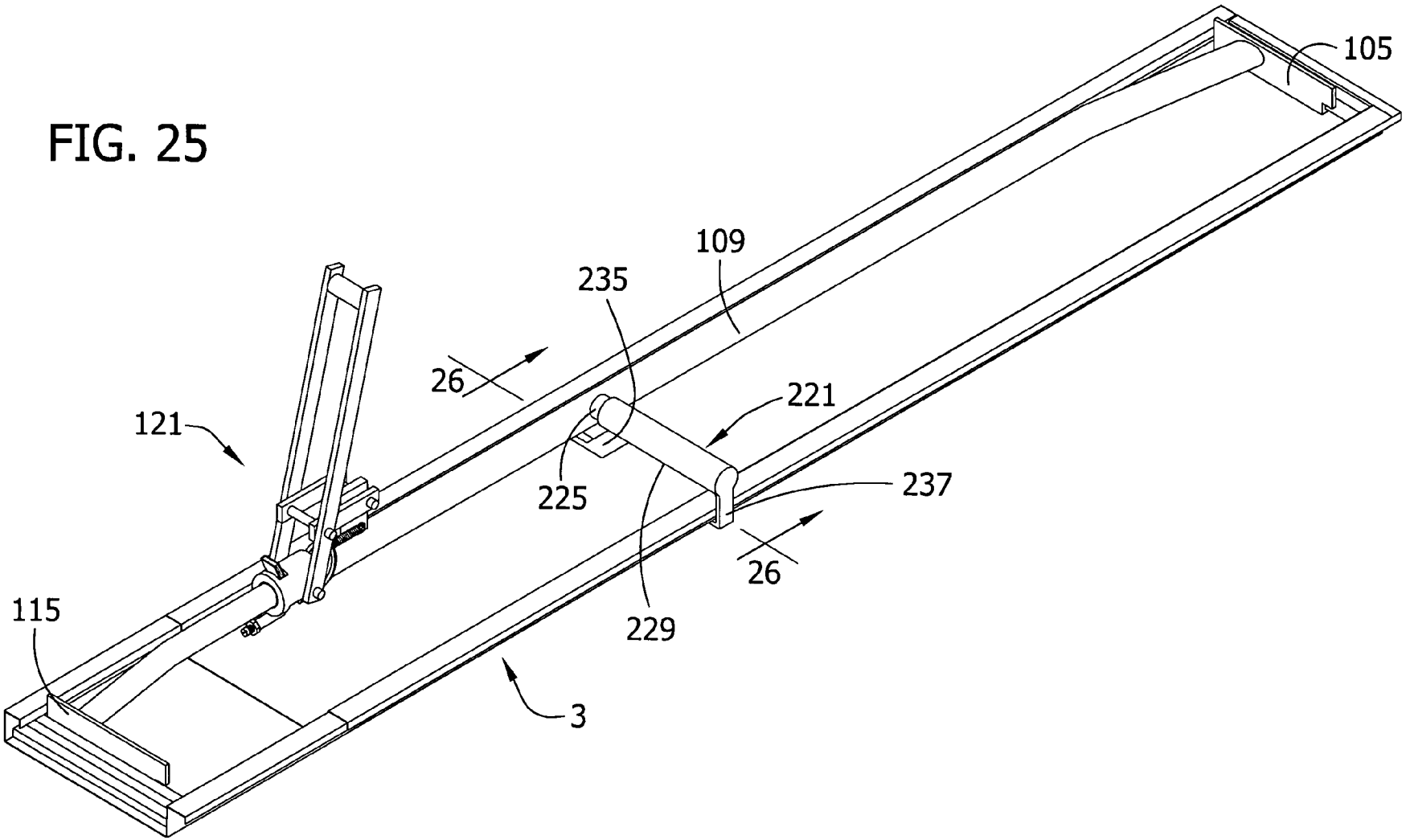

FIGS. 23-26 illustrate how the jack 101 may be used to carry a panel 3 from a first location to a second location. Typically, a panel 3 to be installed will be laying on a surface in a generally contracted position, i.e., a position in which the panel members 11, 13 are not fully extended relative to one another as shown in FIG. 23. The jack 101 is moved to a position in which the support 115 on the extensible member 113 of the jack engages the head 37 of the upper panel member 13, the base 105 of the jack engages the foot 41 of the lower panel member 11, and the telescoping portions 109B, 113A of the jack are adjacent the side of the panel with the in-turned flanges 19. With the two handle members 225, 229 in the retracted position shown in FIG. 23, the outer handle member 229 is pulled against the bias of the spring mechanism 231 to an extended position in which the finger-shaped and J-shaped holders 235, 237 are located beyond respective flanges 19, 21 of the panel (see FIG. 24). The outer handle member 229 is then rotated to the position shown in FIG. 25 and released. Upon release, the spring mechanism 231 causes the outer handle member 229 to slidably retract on the inner handle member 225 to bring the two holders 235, 237 into holding positions in which the finger-shaped holder 235 underlies the lips 27 of the in-turned flange portions 25 of the panel and the J-shaped holder 237 hooks under the lips 33 of the out-turned portions 31 of the of the panel (see FIG. 26). With the holders 235, 237 in this position, the handle 221 may be used to readily lift and carry the panel 3 to the desired location for installation. Because the jack 101 is already positioned for use to install the panel, installation time is reduced. Other handle configurations are possible.

Another advantage of using the jack 101 to carry a panel 3 is that the upper and lower panel members 11, 13 of the panel are held in assembly during transport. It will be noted in this regard, that the overlapping panel design of the present invention allows the panel member to "hinge" or pivot apart. With the jack clamped in place using the handle 221, the two panel members cannot separate in this manner.

Use of the panel system of the present invention to install a mine ventilation structure will now be described. For purposes of illustration, the structure described will be the mine stopping 1 shown in FIG. 1.

Figure 27:
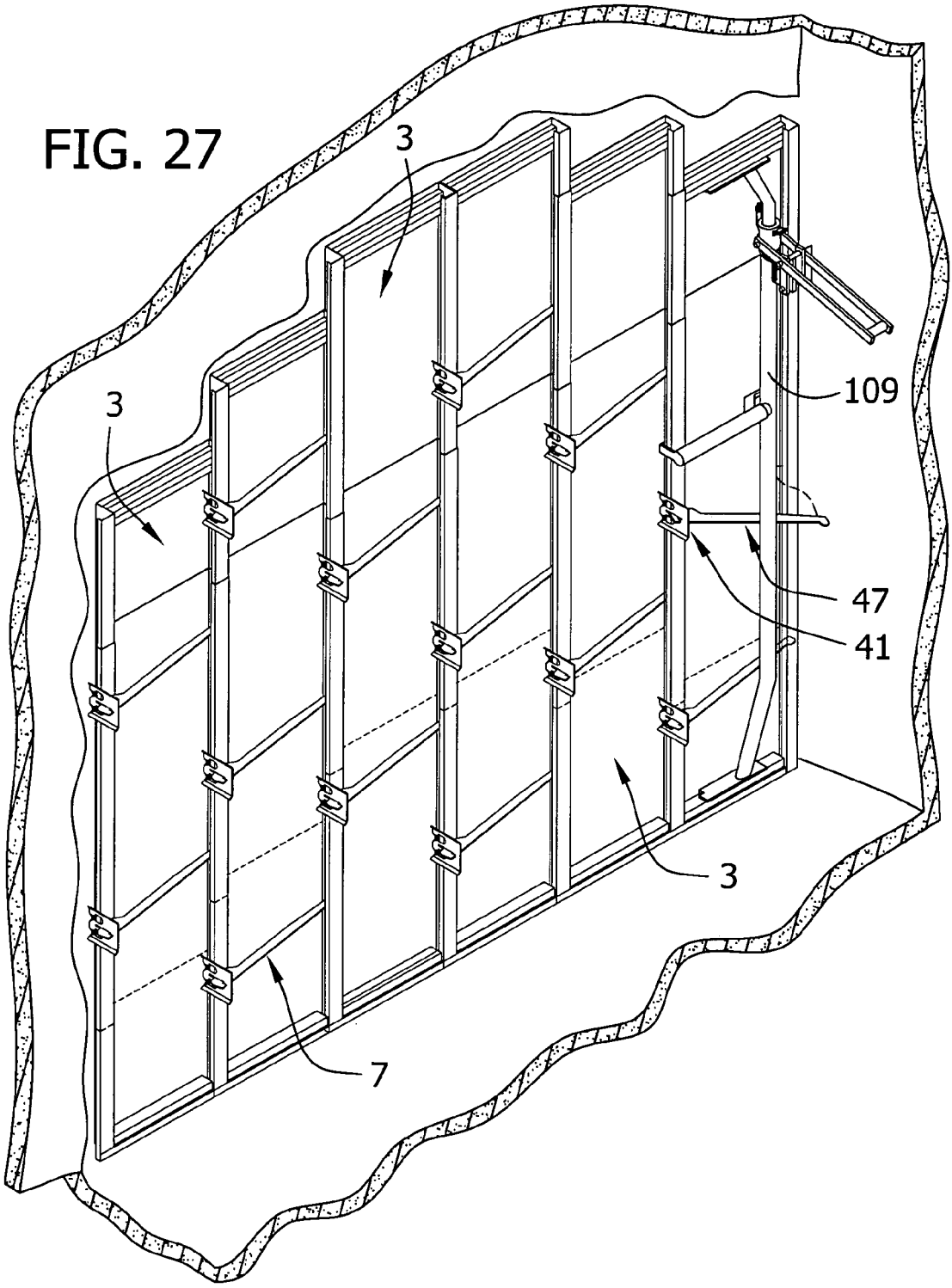
FIG. 27 is a view illustrating operation of the jack and clamping devices to install a mine stopping.

To make the mine stopping, a plurality of panels 3 are installed in side-by-side relation with the flanges 19, 21 of the panels overlapping. The panels may be installed using the jack 101 described above. The process begins by using the jack in the manner previously described to carry a panel 3 from a supply of panels at a first location, typically near the installation site, to the place where the stopping is to be erected. With the panel in a vertical position with its lower end on the floor F of the mine, the jack 101 is used to extend the upper panel member 13. By moving the lever device 133 of the jack through a series of short partial strokes in the low-force range of movement, the panel 3 can be rapidly extended until its upper end (which may contain a sealing member 39) is immediately adjacent the roof R of the mine passage, following which the lever device is moved through one or more short partial strokes in the high-force range of movement to bring the upper end of the panel into pressure engagement with the roof. The lever device 133 is then moved to its over-center locking position (FIG. 21). The panel is secured in its extended position by using one or more clamping devices 7. At least one clamp 41 is applied to the overlapping flanges 19, 21 of the panels in the area of panel overlap, and a lever 47 is used to move the clamp to its clamping position to clamp the overlapping flanges together and thus secure the panel in its extended position. (The pivoting of the lever is permitted because of the offset construction of the jack, as shown in FIG. 27.) To lock the clamp 41 in position, the handle end 77 of the lever 47 is positioned under the flanges 19 at the side of the panel opposite the clamp. Additional clamping devices 7 may be applied to the panel along its length, as needed.

After the first panel is secured in place, the lever device 133 of the jack 101 is moved through a release stroke to collapse the jack so that it can be removed from the panel 3. The process is then repeated with a second panel 3. The second panel is installed in side-by-side vertical relation to the first panel with the out-turned flange portions 31 (including lips 33) of the second panel overlapping the in-turned flange portions 25 (including lips 27) of the first panel (see FIGS. 4 and 5). After the second panel is extended using the jack 101 (or other means), additional clamping devices 7 are used to secure the upper and lower panel members 11, 13 in their extended position and to secure the first and second panels 3 together in the aforesaid side-by-side relation. One clamping device 7 can be used to achieve this result, assuming the clamp 41 is applied at a location where the upper and lower panel members 11, 13 of the second panel overlap. (At this location, the in-turned flange portions 25 of the first panel overlap the out-turned flange portions 31 of the overlapping upper and lower panel members 11, 13 of the second panel, so that the clamp 41 will exert a clamping force on all such overlapping flange portions. The clamping force on the telescoped flanges 19, 21 of the second panel secure its upper and lower panel members 11, 13 in extended position, and the clamping force exerted on the overlapping flanges 19, 21 of the first and second panels will secure the two panels together.) Typically, more than one clamping device 7 will be used, depending on the length of the panels and other factors. For example, for shorter panels (e.g., five feet or less), two clamping devices 7 may suffice, one where the upper and lower panel members 11, 13 remain telescoped together and another where they do not. For longer panels, three clamping devices 7 may be more appropriate to maintain the overlapping flanges 19, 21 of adjacent panels close together so that the panels function as an integrated structure.

Figure 28:
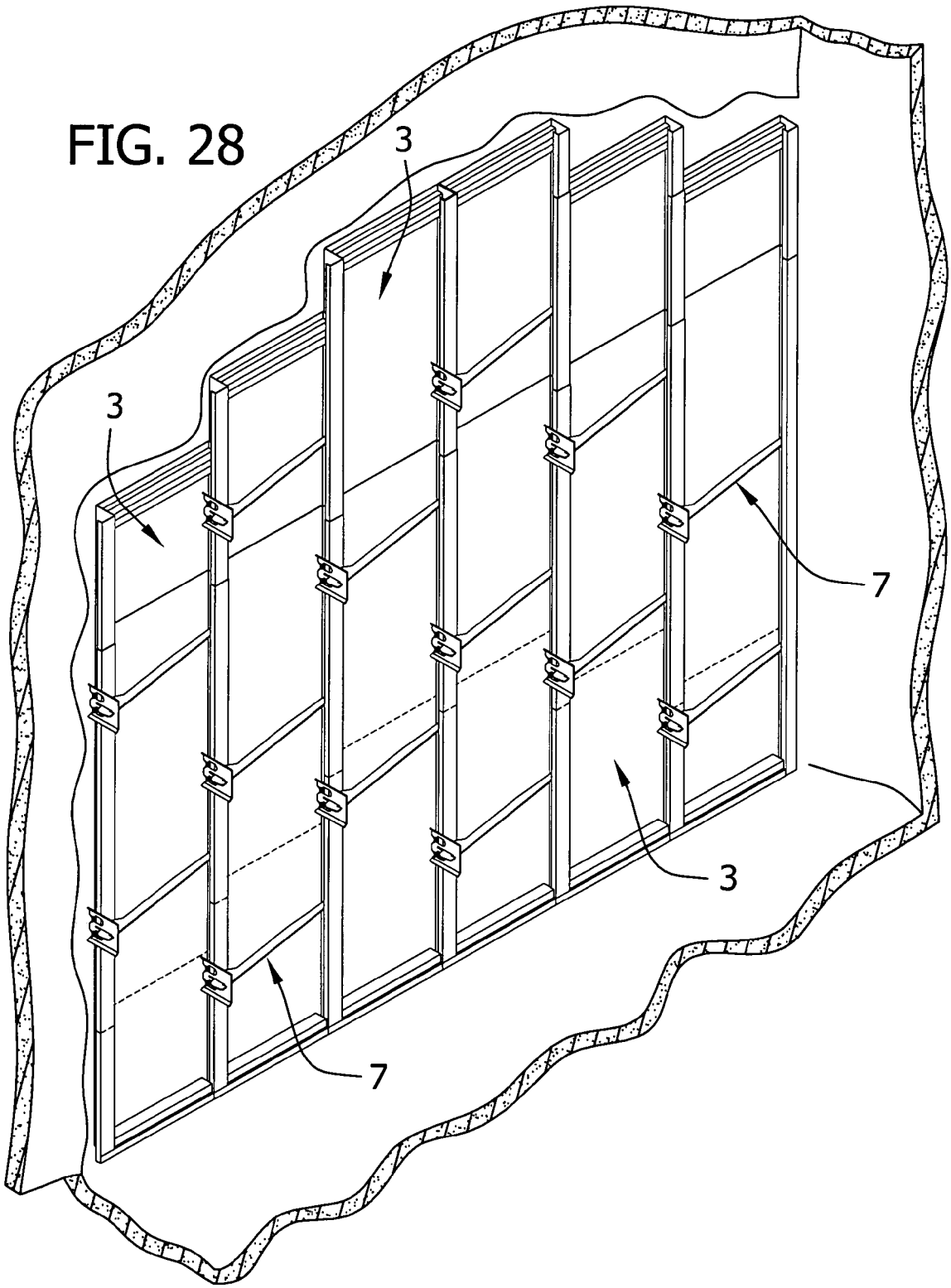
FIG. 28 is a perspective view of a mine stopping after it has been installed using a panel system of this invention.

The above process is repeated for the third and following panels until a wall of panels 3 is formed across the passage, as shown in FIG. 28. Any spaces between the panels and the mine surfaces can be sealed in various ways, such as described in the aforementioned co-assigned patents. Due in significant part to the overlapping nature of the panels, the wall is strong, lightweight, resistant to leakage, and functions as an integral load-bearing unit capable of resisting larger loads due to pressure differentials across the wall, concussive forces within the mine due to blasting, roof rashing or collapse, etc. Further, since the clamping devices 7 exert strong clamping forces on the overlapping flanges 19, 21, preferably sufficient to actually deform the metal, the resistance of the panels to contraction is high. Nevertheless, in the event of a mine convergence between the roof and floor of the mine passage, the panels 3 will yield in the vertical direction to inhibit damage to the stopping. During this convergence, one of the upper and lower panels 11, 13 of each telescoping panel will slide relative to the other panel and relative to the clamping device(s) 7.

Advantageously, the clamping forces exerted by the clamping devices 7 before the convergence are approximately the same as the clamping forces exerted by the clamping devices after the convergence.

Another advantage of the present panel system is that the panels may be quickly installed, due to the elimination of the need for rib angles of prior systems, the quick-acting clamping devices 7, and the improved jack 101. The ventilation structure can be readily disassembled simply by releasing the levers 47 and removing the clamps 41. The panels 3 can be reused.

The panel system described above can be used to make mine ventilation structures other than stoppings, such as overcasts, undercasts and mine seals. (Exemplary overcasts are described in U.S. Pat. Nos. 5,412,916, 5,466,187 and 6,264,549; and exemplary mine seals are described in U.S. Pat. Nos. 5,167,474 and 6,220,785. All of these patents are incorporated herein by reference.) Further, while the overlapping panels 3, clamping devices 7 and jack 101 are useful as part of one overall system, it is contemplated that these various components could be used independent of one another in other systems. Also, while the above stopping installation process is described in the context of the panels extending vertically, it will be understood that the panels could be installed in orientations other than vertical without departing from the scope of this invention. It is also understood that the panel system of the present invention permits a number of panels to be joined together to form a wall which is non-planar. For example, the panels can be joined to form a wall which is curved or has another non-linear shape thereby allowing the panels to be installed in such manner as to avoid obstructions or irregularities in the mine ceiling, floor or walls.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products and methods without departing from the scope of the invention, it is intended that all matter contained in the above description and shown in the accompanying drawing[s] shall be interpreted as illustrative and not in a limiting sense.

What is claimed is:

1. A panel system for making mine ventilation structures, said panel system comprising a plurality of elongate metal panels having flanges along sides thereof configured for overlapping one another when said panels are placed in side-by-side relation whereby when said panels are secured together they form a unitary load-bearing structure, and a plurality of clamping devices engageable with said overlapping flanges for applying a force sufficient to deform the flanges thereby securing said panels together in said side-by-side relation with said flanges overlapping and in frictional contact with one another.

2. A panel system as set forth in claim 1 wherein at least one of said clamping devices comprises a clamp engageable with two or more of said overlapping flanges, and a lever for moving said clamping device to a clamping position in which the clamping device clamps the flanges together.

3. A panel system as set forth in claim 1 wherein each panel is a sheet metal panel of generally channel shape in cross section having a web and first and second flanges at opposite sides of the web.

4. A mine overcast or undercast comprising a plurality of the panels of claim 1 secured together in generally horizontal side-by-side relation.

5. A panel system for making mine ventilation structures, said panel system comprising a plurality of elongate metal panels having flanges along sides thereof configured for overlapping one another when said panels are placed in side-by-side relation whereby when said panels are secured together they form a unitary load-bearing structure, each panel being a sheet metal panel of generally channel shape in cross section having a web and first and second flanges at opposite sides of the web, said first flange having an in-turned portion at its outer edge extending generally toward the second flange but terminating short of the second flange to form a gap therebetween, and wherein said second flange has an out-turned portion at its outer edge extending generally away from said first flange and adapted to overlap the in-turned portion of the first flange of an adjacent panel.

6. A panel system as set forth in claim 5 further comprising a panel securing system for securing said first and second panels together in said side-by-side relation with the side flanges along one side of the first panel generally adjacent the side flanges along an adjacent side of the second panel, and with the out-turned flange portions of the first panel overlapping the in-turned flange portions of the second panel.

7. A panel system as set forth in claim 6 wherein said panel securing system comprises a plurality of clamping devices for clamping the overlapping in-turned and out-turned flange portions of adjacent panels against one another.

8. A panel system as set forth in claim 7 wherein said clamping devices are adapted to be positioned on the overlapping in-turned and out-turned flange portions of adjacent panels and moved to a clamping position in which the clamping device applies a clamping force to said overlapping flange portions sufficient to deform the flange portions.

9. A panel system as set forth in claim 8 wherein the in-turned portion of each first flange is bent at its outer edge to define a first lip extending generally toward the web, and wherein the out-turned portion of each second flange is bent at its outer edge to define a second lip extending generally parallel to the first lip on the first flange, said first and second lips of adjacent panels being adapted to overlap when said in-turned and out-turned flange portions of adjacent panels overlap.

10. A panel system as set forth in claim 9 wherein said clamping members are engageable with the first and second lips of adjacent panels to draw the first and second overlapping flange portions of said panels into clamping engagement to secure the panels in fixed side-by-side relation relative to one another.

11. A panel system as set forth in claim 10 wherein one or more of said clamping devices comprises a clamp having at least one panel engaging member thereon, and a lever for pivoting the clamp to said clamping position to bring said at least one panel engaging member into pressure engagement with said overlapping lips thereby to deform the lips.

12. A panel system as set forth in claim 11 wherein said lever also functions to retain said clamp in said clamping position.

13. A panel system as set forth in claim 12 wherein said lever has a first end engageable with said clamp and a second end adapted to be grasped as a handle to pivot the clamp to its clamping position.

14. A panel system as set forth in claim 13 wherein the lever has a length such that when the lever is used to pivot the clamp to its clamping position, the lever bridges said gap for placement of the handle end of the lever under the in-turned portion of said first flange of a respective panel thereby to hold the lever in a position in which the clamp member is retained in its clamping position.

15. A panel system as set forth in claim 14 wherein said first flange, said in-turned portion of the first flange, and the first lip of said in-turned flange portion define a space, and wherein the handle end of the lever has a projection thereon sized to project into said space to inhibit the unintentional release of the clamp member from its clamping position.

16. A panel system as set forth in claim 12 wherein said lever has a fulcrum generally adjacent its first end, said fulcrum having a camming surface adapted to contact said overlapping flange portions as the lever is used to pivot the clamp to its clamping position.

17. A panel system as set forth in claim 16 wherein said camming surface functions to increase said clamping force applied by said clamp to said overlapping first and second lips as the clamp moves toward its said clamping position.

18. A panel system as set forth in claim 11 wherein said clamp comprises a metal plate having said at least one panel member extending at an oblique angle from the plate.

19. A panel system as set forth in claim 18 wherein said at least one panel engaging member is struck from the plate to form a hole in the plate.

20. A panel system as set forth in claim 19 wherein when said clamp is pivoted to its clamping position, portions of the overlapping lips are deformed into said at least one hole.

21. A panel system as set forth in claim 18 wherein said panel engaging member has an arcuate surface adapted for pressure engagement with said overlapping lips.

22. A panel system as set forth in claim 18 wherein said metal plate has at least two of said panel engaging members and at least two of said holes adjacent the panel engaging members.

23. A panel system as set forth in claim 22 wherein said plate has slot between said at least two panel members for receiving said lever.

24. A panel system as set forth in claim 5 wherein said panel comprises upper and lower panel members of said generally channel shape in cross section, one panel member being sized to have a sliding telescoping fit inside the other panel member with the webs of the panel members generally face-to-face and with the in-turned and out-turned portions of the flanges of one panel member, constituting an inner panel member of the panel, being disposed inward of and overlapping respective in-turned and out-turned portions of the flanges of the other panel member, constituting an outer member of the panel.

25. A panel system as set forth in claim 24 further comprising a panel securing system for securing said panels together in said vertical side-by-side relation with the side flanges along one side of a first panel generally adjacent the side flanges along an adjacent side of a second panel, and with the out-turned flange portions of the first panel overlapping the in-turned flange portions of the second panel.

26. A panel system as set forth in claim 25 wherein said panel securing system comprises a plurality of clamping devices for clamping the overlapping in-turned and out-turned flange portions of adjacent panels against one another to hold the adjacent panels together and to yieldably hold the upper and lower panel members of each panel in fixed position relative to one another.

27. A panel system as set forth in claim 26 wherein said upper and lower panel members are adapted to extend vertically in side-by-side relation between a roof and floor of a mine passage, and wherein said panel members are adapted for telescoping movement relative to one another to accommodate convergence between the roof and floor of the mine passage, said clamping devices permitting such telescoping movement while maintaining clamping forces on the panels during and after said convergence.

28. A panel system as set forth in claim 27 wherein at least one of said upper and lower panel members slide relative to a respective clamping device during said telescoping movement.

29. A panel system as set forth in claim 28 wherein the clamping forces exerted by said clamping devices are approximately the same both before and after said convergence.

30. A panel securing system for securing first and second elongate panels together in side-by-side relation in a mine passageway with a side flange along one side of the first panel overlapping a side flange along an adjacent side of the second panel, said panel securing system comprising at least one clamping device for clamping the overlapping flanges of adjacent panels against one another to hold the panels together in said side-by-side relation, said clamping device being adapted to be positioned on the overlapping flanges of adjacent panels and moved to a clamping position in which the clamping device applies a clamping force to said overlapping flanges.

31. A panel securing system as set forth in claim 30 wherein said clamping device is configured for applying a clamping force sufficient to deform said overlapping flanges.

32. A panel securing system as set forth in claim 30 wherein the clamping device is adapted for clamping an out-turned portion of the flange of the first panel in overlapping relation with an in-turned portion of the flange of the second panel.

33. A panel securing system as set forth in claim 32 wherein said overlapping flange portions have outer edges bent to define overlapping lips, and wherein said at least one clamping device is engageable with said overlapping lips of said adjacent panels to draw the overlapping flange portions of the panels into clamping engagement to secure the panels in fixed side-by-side relation relative to one another.

34. A panel securing system as set forth in claim 33 wherein said clamping device is configured for applying a clamping force sufficient to deform said overlapping lips when the overlapping flange portions are drawn into clamping engagement.

35. A panel securing system as set forth in claim 34 wherein said at least one clamping device comprises a clamp configured having at least one panel engaging member thereon, and a lever for pivoting the clamp to said clamping position to bring said at least one panel engaging member into pressure engagement with said overlapping lips thereby to deform the lips.

36. A panel securing system as set forth in claim 35 wherein said lever also functions to retain said clamp in said clamping position.

37. A panel securing system as set forth in claim 35 wherein said lever has a first end engageable with said clamp and a second end adapted to be grasped as a handle to pivot the clamp to its clamping position.

38. A panel securing system as set forth in claim 37 wherein said lever has a fulcrum generally adjacent its first end, said fulcrum having a camming surface adapted to contact said overlapping flange portions as the lever is used to pivot the clamp to its clamping position.

39. A panel securing system as set forth in claim 38 wherein said camming surface functions to increase said clamping force applied by said clamp to said overlapping lips as the clamp moves toward its said clamping position.

40. A panel securing system as set forth in claim 36 wherein the lever has a length such that when the lever is used to pivot the clamp to its clamping position, the lever is positioned for placement of the handle end of the lever under the in-turned flange portion of a respective panel thereby to hold the lever in a position in which the clamp is retained in its clamping position.

41. A panel securing system as set forth in claim 40 wherein the handle end of the lever has a projection thereon sized to project a space defined in part by said in-turned flange portion to inhibit the unintentional release of the clamp from its clamping position.

42. A panel securing system as set forth in claim 35 wherein said clamp comprises a metal plate having said at least one panel engaging member on the plate.

43. A panel securing system as set forth in claim 42 wherein said panel engaging member has an arcuate surface adapted for pressure engagement with said overlapping lips.

44. A panel securing system as set forth in claim 42 wherein said metal plate has at least two of said panel engaging members and at least two holes adjacent the panel engaging members.

45. A panel securing system as set forth in claim 44 wherein said plate has slot between said at least two panel engaging members for receiving said lever.

46. A panel securing system as set forth in claim 35 wherein said at least one panel engaging member is struck from the plate to form a hole in the plate.

47. A panel securing system as set forth in claim 46 wherein when said clamp is pivoted to its clamping position, portions of the overlapping lips are deformed into said at least one hole.

48. A panel securing system as set forth in claim 30 wherein each of said first and second panels comprises upper and lower panel members having a telescoping sliding fit with one another to provide for extension and retraction of the upper and lower panel members relative to one another.

49. A panel securing system for securing first and second elongate panels together in side-by-side relation in a mine passageway with a side flange along one side of the first panel generally adjacent and overlapping a side flange along an adjacent side of the second panel, said panel securing system comprising at least one clamping device adapted to be positioned on the overlapping flanges of adjacent panels and moved to a clamping position in which the clamping device applies a clamping force to said overlapping flanges sufficient to hold the adjacent panels together in said side-by-side relation, said at least one clamping device comprising a clamp and a lever for pivoting the clamp to said clamping position to bring a portion of said clamp into pressure engagement with said overlapping flanges to clamp said flanges together.

50. A panel securing system as set forth in claim 49 wherein said lever also functions to retain said clamp in said clamping position.

51. A panel securing system as set forth in claim 50 wherein said lever has an end adapted to be grasped as a handle to pivot the clamp to its clamping position.

52. A panel securing system as set forth in claim 50 wherein said lever has a fulcrum having a camming surface adapted to contact said overlapping flanges as the lever is used to pivot the clamp to its clamping position.

53. A panel securing system as set forth in claim 52 wherein said camming surface functions to increase said clamping force applied by said clamp to said overlapping lips as the clamp moves toward its said clamping position.

54. A panel securing system as set forth in claim 49 wherein the lever has a length such that when the lever is used to pivot the clamp to its clamping position, the lever is positioned for placement of the handle end of the lever under a flange of a respective panel thereby to hold the lever in a position in which the clamp is retained in its clamping position.

55. A panel securing system as set forth in claim 49 wherein the handle end of the lever has a projection thereon sized to project into a space defined in part by a flange of a panel to inhibit the unintentional release of the clamp from its clamping position.

56. A panel securing system as set forth in claim 49 wherein said clamp comprises a metal plate and said portion of the plate adapted for pressure engagement with said overlapping flanges comprises one or more tongues extending from the plate at one side of the plate.

57. A panel securing system as set forth in claim 56 wherein said plate has a slot for receiving said lever.

58. A panel securing system as set forth in claim 49 wherein each of said first and second panels comprises upper and lower panel members having a telescoping sliding fit with one another to provide for extension and retraction of the upper and lower panel members relative to one another.

59. A panel securing system as set forth in claim 58 wherein said upper and lower panel members are adapted to extend vertically in side-by-side relation between a roof and floor of a mine passage, and wherein said panel members are adapted for telescoping movement relative to one another to accommodate convergence between the roof and floor of the mine passage, said clamping devices permitting such telescoping movement while maintaining clamping forces on the panels during and after said convergence.

60. A panel securing system as set forth in claim 59 wherein at least one of said upper and lower panel members slide relative to a respective clamping device during said telescoping movement.

61. A panel securing system as set forth in claim 58 wherein the clamping forces exerted by said clamping devices are approximately the same both before and after said convergence.

62. A method of making a mine ventilation structure from a plurality of elongate metal panels having flanges along opposite sides thereof, said method comprising the steps of:

placing said panels in side-by-side relation with the flanges of one panel overlapping the flanges of an adjacent panel, and securing the panels together in said side-by-side relation to form a unitary load-bearing structure by clamping said panels together with a force sufficient to deform at least some of said overlapping flanges.

63. A method as set forth in claim 62 wherein said structure is a mine stopping.

64. A method as set forth in claim 62 wherein said structure is an overcast.

65. A method as set forth in claim 62 wherein said structure is an undercast.

66. A method as set forth in claim 62 wherein said structure is a mine seal.

67. A method as set forth in claim 62 wherein each panel comprises a pair of extensible panel members, said method further comprising using a jack to extend said panel members relative to one another prior to said securing step.

68. A method of making a mine ventilation structure from a plurality of elongate metal panels having flanges along opposite sides thereof, said method comprising the steps of:

placing said panels in side-by-side relation with the flanges of one panel overlapping the flanges of an adjacent panel, and securing the panels together in said side-by-side relation to form a unitary load-bearing structure by applying clamps to said overlapping flanges, and pivoting each clamp to a clamping position to clamp the overlapping flanges together.

69. A method as set forth in claim 68 wherein said clamp is pivoted using a lever.

70. A method as forth in claim 69 wherein said lever is engaged with an overlapping flange to retain the clamp in said clamping position.

71. A method as set forth in claim 68 wherein said structure is a mine stopping.

72. A method as set forth in claim 68 wherein said structure is an overcast.

73. A method as set forth in claim 68 wherein said structure is an undercast.

74. A method as set forth in claim 68 wherein said structure is a mine seal.

75. A method as set forth in claim 68 wherein each panel comprises a pair of extensible panel members, said method further comprising using a jack to extend said panel members relative to one another prior to said securing step.

* * * * *